US009857704B2

(12) United States Patent
Ito et al.

(10) Patent No.: US 9,857,704 B2
(45) Date of Patent: Jan. 2, 2018

(54) ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Yota Ito, Mishima (JP); Hiroyuki Tomono, Numazu (JP); Takashi Anezaki, Hiratsuka (JP); Daisuke Miura, Tokyo (JP); Harunobu Ogaki, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/832,720

(22) Filed: Aug. 21, 2015

(65) Prior Publication Data

US 2016/0054667 A1 Feb. 25, 2016

(30) Foreign Application Priority Data

Aug. 25, 2014 (JP) ..... 2014-170998
Dec. 25, 2014 (JP) ..... 2014-262504
Jul. 3, 2015 (JP) ..... 2015-134772

(51) Int. Cl.
*G03G 15/02* (2006.01)
*G03G 5/047* (2006.01)
(Continued)

(52) U.S. Cl.
CPC ..... *G03G 5/047* (2013.01); *G03G 5/056* (2013.01); *G03G 5/0564* (2013.01); *G03G 5/144* (2013.01);
(Continued)

(58) Field of Classification Search
CPC ..... G03G 5/04; G03G 5/043; G03G 5/047; G03G 5/147; G03G 15/75; G03G 15/751; G03G 15/025; G03G 15/0813
(Continued)

(56) References Cited

U.S. PATENT DOCUMENTS 4,767,693 A * 8/1988 Oba ..... G11B 7/2472 430/21
2002/0051654 A1* 5/2002 Niimi ..... G03G 5/075 399/159
(Continued)

FOREIGN PATENT DOCUMENTS

JP 59-184359 A 10/1984
JP 2002-107986 A 4/2002

OTHER PUBLICATIONS

C.W. Bunn, "The Melting Points fo Chain Polymers", Journal of Polymer Science. vol. XVI, pp. 323-343 (1955).

*Primary Examiner* — Benjamin Schmitt
(74) *Attorney, Agent, or Firm* — Canon U.S.A., Inc. IP Division

(57) ABSTRACT

A process cartridge includes an electrophotographic photosensitive member and a gap retaining member, where the electrophotographic photosensitive member includes a first region having an undercoat layer, a charge generating layer, and a charge transporting layer on a support in this order and a second region having an undercoat layer and a charge transporting layer on a support in this order, the undercoat layer contains a metal oxide particle and any one of an urethane resin, an amino resin, and a polyamide resin as a binder resin, and the charge transporting layer contains a charge transporting substance and at least one selected from the group consisting of a polycarbonate resin and a polyester resin, and where the gap retaining member comes into
(Continued)

contact with a surface of the second region of the electrophotographic photosensitive member.

8 Claims, 3 Drawing Sheets

(51) Int. Cl.
*G03G 5/14* (2006.01)
*G03G 5/05* (2006.01)
*G03G 15/08* (2006.01)
*G03G 15/00* (2006.01)

(52) U.S. Cl.
CPC ..... *G03G 15/025* (2013.01); *G03G 15/0813* (2013.01); *G03G 15/751* (2013.01)

(58) Field of Classification Search
USPC ..... 399/116, 159
See application file for complete search history.

(56) References Cited

U.S. PATENT DOCUMENTS

2005/0158640 A1* 7/2005 Chambers ..... G03G 5/14 430/60
2008/0070135 A1* 3/2008 Tada ..... G03G 5/04 430/57.1
2011/0269064 A1* 11/2011 Wu ..... G03G 5/0614 430/58.8
2014/0004455 A1* 1/2014 Sekido ..... G03G 15/00 430/56
2014/0011127 A1* 1/2014 Nakamura ..... G03G 5/0575 430/56

* cited by examiner

ELECTROPHOTOGRAPHIC PHOTOSENSITIVE MEMBER, PROCESS CARTRIDGE, AND ELECTROPHOTOGRAPHIC APPARATUS

BACKGROUND

Field

Aspects of the present invention generally relate to an electrophotographic photosensitive member and, in addition, a process cartridge and an electrophotographic apparatus which include the electrophotographic photosensitive member.

Description of the Related Art

An electrophotographic photosensitive member is mounted on a process cartridge or an electrophotographic apparatus and a charging device, an exposure device, a developing device, a transfer device, a cleaning device, and the like are provided around the electrophotographic photosensitive member. In an electrophotographic apparatus, image forming is performed through the steps by using these devices. The electrophotographic photosensitive member undergoes slide-rubbing and contact pressure with these devices and members around them and damage and abrasion occur easily.

In recent years, higher speed, long lifetime process cartridges and electrophotographic apparatuses have been required, and improvement in the long-term durability of the electrophotographic photosensitive member has been desired. Along with increases in speed and lifetime, damage and abrasion due to slide-rubbing and a contact pressure (contact force) between the charge transporting layer of the electrophotographic photosensitive member and the member which comes into contact therewith increase, so that more improvement in the durability of the charge transporting layer is desired. In particular, an influence on the electrophotographic photosensitive member exerted by application of the contact pressure (contact force) from a gap retaining member configured to retain (regulate) a distance between the electrophotographic photosensitive member and a charging member or a developer bearing member is large, and the charge transporting layer of the electrophotographic photosensitive member may be peeled in long-term repetitive use.

In the electrophotographic photosensitive member, in many cases, an undercoat layer is disposed to control movement of charges from a support to a photosensitive layer and enhance the adhesive force between the support and the photosensitive layer. However, even in the case where the undercoat layer is disposed, there is a problem that the photosensitive layer is peeled easily in a region (non-image forming region) of the electrophotographic photosensitive member which comes into contact with the gap retaining member. Then, Japanese Patent Laid-Open No. 59-184359 describes a technology in which an end portion of the photosensitive layer is formed inside an end portion of the undercoat layer.

Also, Japanese Patent Laid-Open No. 2002-107986 describes a technology in which a photosensitive layer is formed in such a way as to cover an undercoat layer containing a metal oxide particle, suppress flaking of the metal oxide particle on the surface of the undercoat layer, and suppress soiling of the surface layer of the electrophotographic photosensitive member.

As a result of studies conducted by the present inventors, it was found that in the case where a charge transporting layer serving as a surface layer was formed on an undercoat layer containing a phenol resin and a metal oxide particle, referring to the technology described in Japanese Patent Laid-Open No. 2002-107986, a surface layer peeling problem was not always improved. In particular, the charge transporting layer in the region which came into contact with the gap retaining member was peeled easily. In addition, it was found that peeling of the charge transporting layer occurred more easily in a low-temperature, low-humidity environment and there was room for further improvement.

SUMMARY

Aspects of the present invention generally provide a process cartridge and an electrophotographic apparatus, wherein peeling of a surface layer in the region which comes into contact with a gap retaining member of an electrophotographic photosensitive member in long-term repetitive use is suppressed. An electrophotographic photosensitive member suitable for them is also generally provided.

Aspects of the present invention generally relate to a process cartridge detachably mountable to a main body of an electrophotographic apparatus, including an electrophotographic photosensitive member, a charging member for charging the electrophotographic photosensitive member, a developer bearing member for supplying developer to the electrophotographic photosensitive member, and a gap retaining member configured to retain a distance between the electrophotographic photosensitive member and the charging member or the developer bearing member, wherein the electrophotographic photosensitive member includes a first region having an undercoat layer, a charge generating layer, and a charge transporting layer on a support in this order and a second region having an undercoat layer and a charge transporting layer on a support in this order, the charge transporting layer is a surface layer, and the charge transporting layer contains a charge transporting substance and at least one selected from the group consisting of a polycarbonate resin and a polyester resin, the undercoat layer contains a metal oxide particle and any one of an urethane resin, an amino resin and a polyamide resin as a binder resin, and wherein the gap retaining member comes into contact with a surface of the second region of the electrophotographic photosensitive member.

Aspects of the present invention relate to an electrophotographic photosensitive member including an electrophotographic photosensitive member, a charging member for charging the electrophotographic photosensitive member, a developer bearing member for supplying developer to the electrophotographic photosensitive member, and a gap retaining member configured to retain a distance between the electrophotographic photosensitive member and the charging member or the developer bearing member, wherein the electrophotographic photosensitive member includes a first region having an undercoat layer, a charge generating layer, and a charge transporting layer on a support in this order and a second region having an undercoat layer and a charge transporting layer on a support in this order, wherein the charge transporting layer is a surface layer, and the charge transporting layer contains a charge transporting substance and at least one selected from the group consisting of a polycarbonate resin and a polyester resin, the undercoat layer contains a metal oxide particle and any one of an urethane resin, an amino resin and a polyamide resin as a binder resin and wherein the gap retaining member comes into contact with a surface of the second region of the electrophotographic photosensitive member.

Aspects of the present invention relate to an electrophotographic photosensitive member including a first region having an undercoat layer, a charge generating layer, and a charge transporting layer on a support in this order and a second region having an undercoat layer and a charge transporting layer on a support in this order, wherein the charge transporting layer is a surface layer, and the charge transporting layer contains a charge transporting substance and at least one selected from the group consisting of a polycarbonate resin and a polyester resin, and the undercoat layer contains a metal oxide particle and any one of an urethane resin, an amino resin and a polyamide resin as a binder resin.

Further features of the present disclosure will become apparent from the following description of exemplary embodiments with reference to the attached drawings.

DESCRIPTION OF THE EMBODIMENTS

Figure 1:
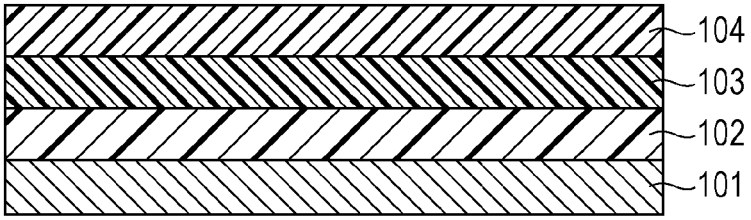
FIG. 1 is a diagram showing an example of the layer configuration of an electrophotographic photosensitive member.

An electrophotographic photosensitive member according to the aspects of the present invention has two regions (portions). One is a first region having a support, an undercoat layer disposed on the support, a charge generating layer disposed on the undercoat layer, and a charge transporting layer disposed on the charge generating layer. That is, the first region has the undercoat layer, the charge generating layer, and the charge transporting layer on the support in this order. The other is a second region having a support, an undercoat layer disposed on the support, and a charge transporting layer disposed just above the undercoat layer. That is, the second region has the undercoat layer and the charge transporting layer on the support in this order. The undercoat layer contains a metal oxide particle and any one of an urethane resin, an amino resin and a polyamide resin as a binder resin. The charge transporting layer contains a charge transporting substance and at least one selected from the group consisting of a polycarbonate resin and a polyester resin, and the charge transporting layer is a surface layer.

In the process cartridge and the electrophotographic apparatus, a portion having the above-described support, the undercoat layer disposed on the support, and the charge transporting layer disposed just above the undercoat layer is present in a region which comes into contact with the gap retaining member. That is, the gap retaining member comes into contact with the surface of the second region of the electrophotographic photosensitive member. The gap retaining member comes into contact with the electrophotographic photosensitive member in a non-image forming region of the electrophotographic photosensitive member.

The portion having the support, the undercoat layer disposed on the support, the charge generating layer disposed on the undercoat layer, and the charge transporting layer disposed on the charge generating layer is present in an image forming region of the electrophotographic photosensitive member. The portion having the support, the undercoat layer disposed on the support, and the charge transporting layer disposed just above the undercoat layer is present in a non-image forming region of the electrophotographic photosensitive member. That is, the first region of the electrophotographic photosensitive member is present in the image forming region and the second region of the electrophotographic photosensitive member is present in the non-image forming region.

The image forming region and the non-image forming region of the electrophotographic photosensitive member will be described. In the case where the electrophotographic photosensitive member is fit to the electrophotographic apparatus and image formation is performed, the electrophotographic photosensitive member undergoes a series of electrophotographic process of charge, exposure, development, and transfer.

In general, an electrostatic latent image is formed on the electrophotographic photosensitive member, so that a laser beam (image exposure light) irradiation region of a scanner unit (exposure device) for image formation serves as an image forming region. A region, which is not irradiated with the image exposure light by the exposure device, of the electrophotographic photosensitive member serves as a non-image forming region. In this regard, for the purpose of controlling the image formation condition, the exposure light may be applied to form a developer image (patch) for image density control on the electrophotographic photosensitive member. However, this exposure light is not for image formation and, therefore, is not involved in specifying the above-described image forming region.

In addition, the gap retaining member configured to retain a distance between the electrophotographic photosensitive member and the charging member or the developer bearing member comes into contact with the non-image forming region. In particular, an influence on the electrophotographic photosensitive member exerted by application of the contact pressure (contact force) from the gap retaining member is large, and peeling of the surface layer occurs easily.

The present inventors estimate the reason for suppression of peeling of the surface layer in the region which comes into contact with the gap retaining member of the electrophotographic photosensitive member in long-term repetitive use of the above-described electrophotographic photosensitive member according to aspects of the present invention as described below.

In aspects of the present invention, the gap retaining member comes into contact with the second region of the electrophotographic photosensitive member. In the second region, the charge transporting layer is disposed just above the undercoat layer disposed on the support and the charge generating layer is not interposed. Consequently, the surface layer (charge transporting layer) is suppressed from being worn easily because of changes in surface potential of the surface layer based on generation of charges by exposure light.

In aspects of the present invention, the undercoat layer contains any one of an urethane resin, an amino resin and a polyamide resin as a binder resin and, thereby, the adhesiveness between the undercoat layer and the charge transporting layer may be enhanced.

The case where the undercoat layer contains an urethane resin will be described. A polycarbonate resin or a polyester resin serving as a binder resin of the charge transporting layer has a carbonate group or an ester group containing an oxygen atom with high polarity. On the other hand, the urethane resin in the undercoat layer has an urethane bond containing a nitrogen atom and an oxygen atom with high polarity. It is estimated that contact between the undercoat layer and the charge transporting layer, each having a functional group with high polarity, generates a strong hydrogen bond between the functional groups with high polarity of the undercoat layer and the charge transporting layer. Consequently, an adhesive force between the charge transporting layer and the undercoat layer may be enhanced.

The cohesion energy of an urethane bond of the urethane resin is a very high 8.74 kcal/mol (cited from JOURNAL OF POLYMER SCIENCE, 16, 323-343 (1955)). Therefore, the urethane resin may be divided into a hard segment and a soft segment in the undercoat layer and may exert a high effect of relaxing the stress applied to the charge transporting layer.

The case where the undercoat layer contains an amino resin will be described. The amino resin refers to a resin containing a triazine compound having a triazine ring, e.g., a melamine derivative and a benzoguanamine derivative. A polycarbonate resin or a polyester resin serving as a binder resin of the charge transporting layer has a carbonate group or an ester group containing an oxygen atom with high polarity. On the other hand, the amino resin in the undercoat layer has a triazine ring containing a nitrogen atom with high polarity. It is estimated that contact between the undercoat layer containing a resin having a functional group with high polarity and the charge transporting layer generates a strong hydrogen bond between the functional groups with high polarity of the undercoat layer and the charge transporting layer. Consequently, an adhesive force between the charge transporting layer and the undercoat layer may be enhanced.

The cohesion energy of a triazine ring taking responsibility for cross-linking of the amino resin is a very high 17.0 kcal/mol (calculated from the solubility parameter obtained from HSPiP). Therefore, the amino resin may be divided into a hard segment and a soft segment in the undercoat layer and may exert a high effect of relaxing the stress applied to the charge transporting layer.

The case where the undercoat layer contains a polyamide resin will be described. The polyamide resin refers to a resin having an amide bond. A polycarbonate resin or a polyester resin serving as a binder resin of the charge transporting layer has a carbonate group or an ester group containing an oxygen atom with high polarity. On the other hand, the polyamide resin in the undercoat layer has an amide bond containing a nitrogen atom and an oxygen atom with high polarity. It is estimated that contact between the undercoat layer containing a resin having a functional group with high polarity and the charge transporting layer generates a strong hydrogen bond between the functional groups with high polarity of the undercoat layer and the charge transporting layer. Consequently, an adhesive force between the charge transporting layer and the undercoat layer may be enhanced.

The cohesion energy of an amide bond of the polyamide resin is a very high 8.50 kcal/mol (cited from JOURNAL OF POLYMER SCIENCE, 16, 323-343 (1955)). Therefore, the polyamide resin may be divided into a hard segment and a soft segment in the undercoat layer and may exert a high effect of relaxing the stress applied to the charge transporting layer.

Support

The support can have conductivity (conductive support). For example, the support may be formed from a metal or alloy of aluminum, iron, nickel, copper, gold, and the like. Alternatively, supports in which a thin film of a metal, e.g., aluminum, chromium, silver, or metal, is formed on an insulating support, e.g., a polyester resin, a polycarbonate resin, a polyimide resin, or glass are mentioned. Supports in which a thin film of conductive material, e.g., indium oxide, tin oxide, or zinc oxide, or a thin film of conductive ink including silver nanowires is formed on an insulating support are mentioned. The surface of the support may be subjected to an electrochemical treatment, e.g., anodization, a wet honing treatment, a blast treatment, a cut treatment, or the like for the purpose of improvement of electrical properties and suppression of interference fringe.

Undercoat Layer

The undercoat layer is disposed on the support. The undercoat layer contains a metal oxide particle and any one of an urethane resin, an amino resin and a polyamide resin as a binder resin.

The above-described urethane resin is a polymer of a composition containing an isocyanate compound having an isocyanate group or a block isocyanate group and an organic compound having a hydroxy group. The undercoat layer according to aspects of the present invention can be an urethane resin produced by forming an urethane bond through condensation polymerization in formation of the undercoat layer.

The above-described isocyanate compounds can be isocyanate compounds having 2 to 6 isocyanate groups or bock isocyanate groups. Examples include benzene triisocyanate, methylbenzene triisocyanate, triphenylmethane triisocyanate, lysine triisocyanate and, in addition, isocyanurate-modified products of diisocyanates, e.g., tolylene diisocyanate, hexamethylene diisocyanate, dicyclohexylmethane diisocyanate, naphthalene diisocyanate, diphenylmethane diisocyanate, isophorone diisocyanate, xylylene diisocyanate, 2,2,4-trimethylhexamethylene diisocyanate, methyl-2,6-diisocyanatehxanoate, and norbornane diisocyanate, biuret-modified products, allophanate-modified products, and adduct-modified products with trimethylolpropane and pentaerythritol. Among them, particularly, isocyanurate-modified products can be mentioned. The molecular weight of the isocyanate compound is preferably 200 to 1,300.

The above-described organic compounds having a hydroxy group can be thermoplastic resins having a hydroxy group. Examples of thermoplastic resins having a hydroxy group include polyvinylacetal resins, e.g., a polyvinylbutyral resin, polyolefin resins, e.g., an ethylene vinyl alcohol copolymer resin, and polyol resins, e.g., a polyester polyol resin. The hydroxyl value of the thermoplastic resin having a hydroxy group is preferably 50 mgKOH/g or more, and more preferably 100 mgKOH/g or more to increase the probability of condensation polymerization reaction with the isocyanate compound and form a homogeneous urethane resin. The weight average molecular weight of the thermoplastic resin having the hydroxyl value is preferably within the range of 5,000 to 400,000.

The organic compound having a hydroxy group may contain a charge transporting substance having a hydroxy group and the like besides the above-described thermoplastic resin for the purpose of improving the electrical properties of the undercoat layer. In order to prepare a coating liquid for the undercoat layer, the isocyanate compound and the organic compound having a hydroxy group can be blended in such a way that the reaction molar ratios of NCO group and OH group, respectively, become preferably equal (become 1.0 times). On the other hand, the reaction molar ratios may be differentiated for the purpose of improving the electric properties and further enhancing the adhesive forces with the support and the layers on the upper and lower sides.

The above-described amino resins can be a polymer of a composition containing a triazine compound having a triazine ring, e.g., a melamine derivative and a benzoguanamine derivative, and an organic compound having a hydroxy group. The triazine compound can be a triazine compound having an alkylol group or an alkyl-etherified alkylol group. The undercoat layer according to aspects of the present invention can be an amino resin by forming an ether bond through condensation polymerization in formation of the undercoat layer.

The above-described triazine compounds can be amino compounds including a triazine ring having 2 to 6 alkylol groups or alkyl-etherified alkylol groups. Examples include melamine derivatives, e.g., hexamethoxymethylolmelamine, hexamethylolmelamine, pentamethylolmelamine, and tetramethylolmelamine, and guanamine derivatives, e.g., tetramethoxymethylolbenzoguanamine, tetramethylolbenzoguanamine, and tetramethylolcyclohexylguanamine. Among them, particularly, melamine derivatives can be mentioned. The molecular weight of the triazine compound is preferably 150 to 1,000, and more preferably 180 to 560.

The organic compounds having a hydroxy group are the same as those described with respect to the urethane resin.

The above-described polyamide resin can be a polyamide resin by forming an amide bond through condensation polymerization of diamine and dicarboxylic acid or ring-opening polymerization of caprolactom.

Previously known nylon 6, nylon 11, nylon 12, nylon 66, nylon 610, N-alkoxyalkylated nylons typified by N-methoxymethylated 6 nylon and N-methoxymethylated 12 nylon, nylon copolymers typified by nylon 6-66-610-12 quaternary nylon copolymer, urea resins, and the like may be used as the polyamide resins.

Metal Oxide Particle

Next, metal oxide particles will be described. Examples of metal oxide particles include particles of zinc oxide, white lead, aluminum oxide, indium oxide, silicon oxide, zirconium oxide, tin oxide, titanium oxide, magnesium oxide, antimony oxide, bismuth oxide, tin-doped indium oxide, and antimony- or tantalum-doped tin oxide or zirconium oxide. Among them, particles of zinc oxide, titanium oxide, and tin oxide can be mentioned.

The average primary particle diameter of the metal oxide particles is preferably 30 to 500 nm from the viewpoint of suppression of an occurrence of black spot.

In preparation of the coating liquid for the undercoat layer, the metal oxide particles may be subjected to a surface treatment with a silane coupling agent or the like for the purpose of, for example, improving the dispersibility of the metal oxide particles. In addition, the metal oxide may be doped with other metal or metal oxide for the purpose of, for example, controlling the resistance of the undercoat layer. The film thickness of the undercoat layer is preferably 0.5 to 40 μm, and more preferably 5 to 35 μm.

The undercoat layer may contain additives, e.g., organic particles and leveling agents, to improve the film forming property and the electric properties of the undercoat layer. However, the content of additives in the undercoat layer is preferably 20 percent by mass or less, and more preferably 10 percent by mass or less relative to total mass of the undercoat layer.

At least two layers of undercoat layers may be disposed for the purpose of, for example, separating functions. In this case, at least one layer of the undercoat layers contains a metal oxide particle and any one of an urethane resin, an amino resin and a polyamide resin as a binder resin. The uppermost undercoat layer in the second region contains a metal oxide particle and any one of an urethane resin, an amino resin and a polyamide resin as a binder resin.

Charge Generating Layer

The charge generating layer is disposed on the undercoat layer.

Examples of charge generating substances include azo pigments, perylene pigments, anthraquinone derivatives, anthanthrone derivatives, dibenzopyrenequinone derivatives, pyranthrone derivatives, violanthrone derivatives, isoviolanthrone derivatives, indigo derivatives, thioindigo derivatives, phthalocyanine pigments, e.g., metal phthalocyanine and metal-free phthalocyanine, and bisbenzimidazole derivatives. Among them, azo pigments and phthalocyanine pigments can be mentioned. Among the phthalocyanine pigments, oxytitanium phthalocyanine, chlorogallium phthalocyanine, and hydroxygallium phthalocyanine can be mentioned.

Example of binder resins used for the charge generating layer include polymers and copolymers of vinyl compounds, e.g., styrene, vinyl acetate, vinyl chloride, acrylic acid ester, methacrylic acid ester, vinylidene fluoride, and trifluoroethylene, polyvinyl alcohol resins, polyvinylacetal resins, polycarbonate resins, polyester resins, polysulfone resins, polyphenylene oxide resins, polyurethane resins, cellulose resins, phenol resins, melamine resins, silicon resins, and epoxy resins. Among them, polyester resins, polycarbonate resins, and polyvinylacetal resins can be mentioned, and in particular, polyvinylacetal resins can be mentioned.

In the charge generating layer, the mass ratio of the charge generating substance to the binder resin (charge generating substance/binder resin) is preferably within the range of 10/1 to 1/10, and more preferably within the range of 5/1 to 1/5. The film thickness of the charge generating layer is preferably 0.05 to 5 μm. Examples of the solvents used for the coating liquid for the charge generating layer include alcohol based solvents, sulfoxide based solvents, ketone based solvents, ether based solvents, ester based solvents, and aromatic hydrocarbon solvents.

Charge Transporting Layer

Examples of charge transporting substances used for the charge transporting layer include polycyclic aromatic compounds, heterocyclic compounds, hydrazone compounds, styryl compounds, benzidine compounds, triarylamine compounds, and triphenylamine. Also, polymers having groups derived from these compounds in main chains or side chains are mentioned.

The binder resins used for the charge transporting layer according to aspects of the present invention are polycarbonate resins and polyester resins. A plurality of separate resins may be used for the charge transporting layer by blending or as a copolymer. In addition, they may be used in combination. The weight average molecular weight of the binder resin is preferably within the range of 10,000 to 300,000.

Specific examples of structural units included in the polycarbonate resin are as described below, although not limited to them.

(1-1)
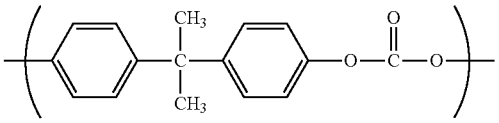
(1-2)
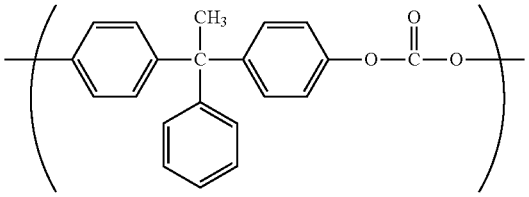
(1-3)
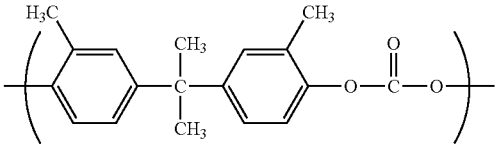
(1-4)
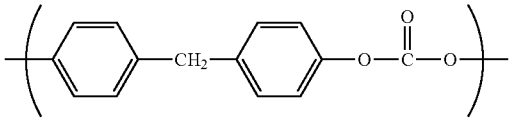
-continued
(1-5)
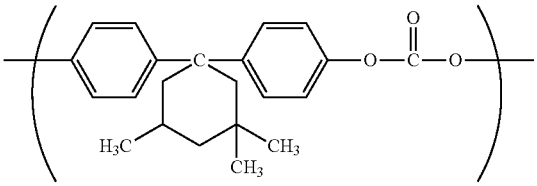
(1-6)
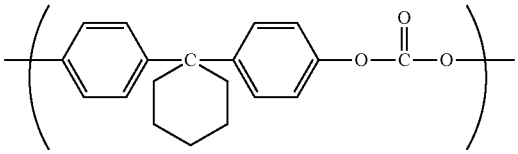
(1-7)
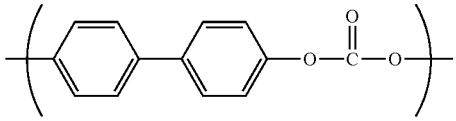
Specific examples of structural units included in the polyester resin are as described below, although not limited to them.
(2-1)
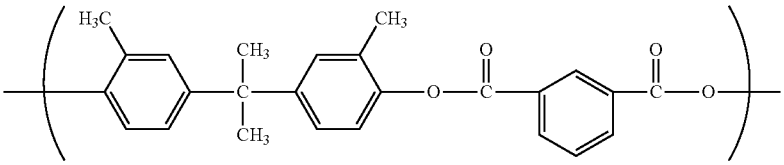
(2-2)
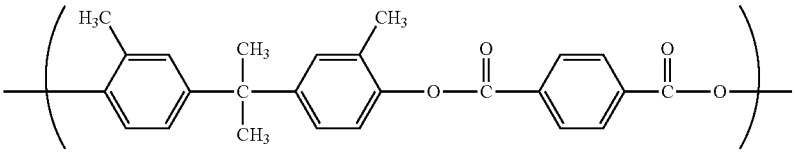
(2-3)
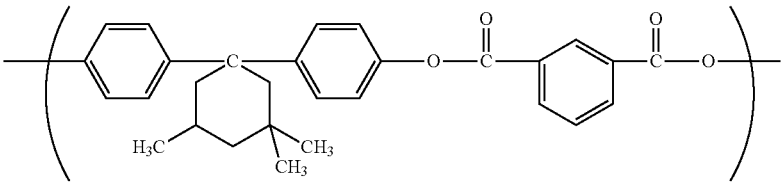
(2-4)
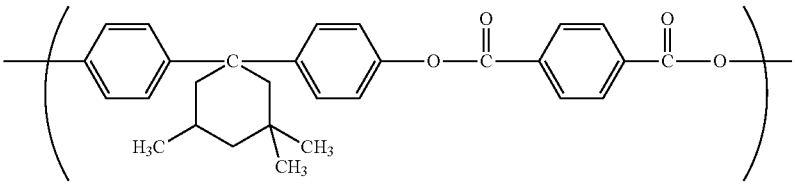

-continued (2-5)

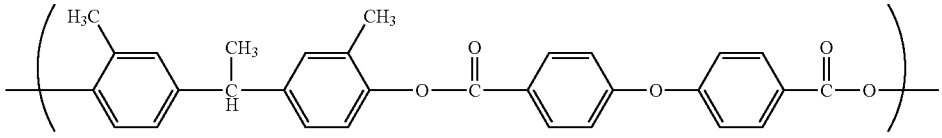

(2-6)

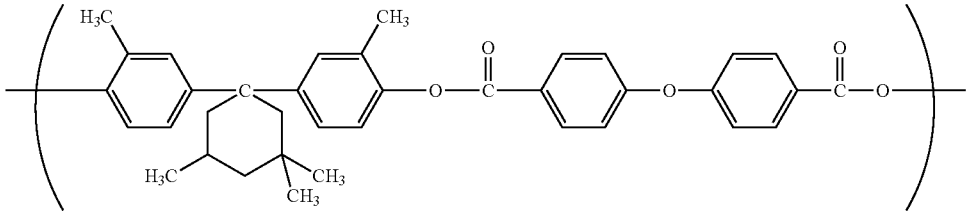

In the charge transporting layer, the mass ratio of the charge transporting substance to the binder resin (charge transporting substance/binder resin) is preferably within the range of 10/5 to 5/10, and more preferably within the range of 10/8 to 6/10. The film thickness of the charge transporting layer is preferably 5 to 40 μm.

Examples of the solvents used for the coating liquid for the charge transporting layer include alcohol based solvents, sulfoxide based solvents, ketone based solvents, ether based solvents, ester based solvents, and aromatic hydrocarbon solvents.

The charge transporting layer may contain additives, e.g., organic particles, leveling agents, and antioxidants, for the purpose of improving the mechanical strength, the film forming property, and the electric properties of the charge transporting layer. However, the content of additives in the charge transporting layer is preferably 30 percent by mass or less, and more preferably 10 percent by mass or less relative to total mass of the charge transporting layer.

The charge generating layer is a layer necessary for image formation in the electrophotographic process and, therefore, the charge generating layer is disposed between the undercoat layer and the charge transporting layer in the image forming region. In the case where the charge generating layer is also formed in the non-image forming region, the charge generating layer can be formed only on the image forming region side of the non-image forming region.

The following methods are mentioned as the methods for forming each of undercoat layer, charge generating layer, charge transporting layer, and the like constituting the electrophotographic photosensitive member. A method in which a layer is formed by dissolving and/or dispersing a material constituting each layer into a solvent, applying the resulting coating liquid to form a coating film, and drying and/or curing the coating film can be employed. Examples of methods for applying the coating liquid include a dip coating method, a spray coating method, a curtain coating method, a spin coating method, and a ring method. Among them, a dip coating method can be mentioned from the viewpoint of the efficiency and the productivity.

In formation of the coating film of the charge generating layer disposed on the undercoat layer, a portion including a charge transporting layer disposed just above the undercoat layer is formed through the steps to adjust a coating position, perform masking, wipe a coating region with lens-cleaning paper, and the like. That is, the second region of the electrophotographic photosensitive member is formed by controlling charge generating layer forming region through the above-described steps.

FIG. 1 is a diagram showing an example of the layer configuration of an electrophotographic photosensitive member in a portion (first region) having an undercoat layer, a charge generating layer, and a charge transporting layer on a support in this order. In FIG. 1, reference numeral 101 denotes a support, reference numeral 102 denotes an undercoat layer, reference numeral 103 denotes a charge generating layer, and reference numeral 104 denotes a charge transporting layer.

Figure 2:
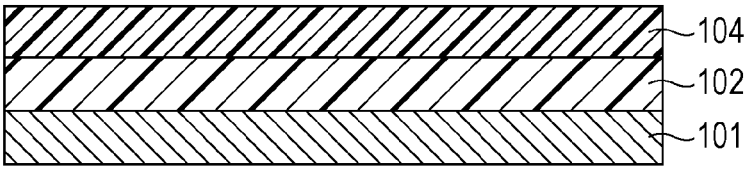
FIG. 2 is a diagram showing an example of the layer configuration of an electrophotographic photosensitive member.

FIG. 2 is a diagram showing an example of the layer configuration of an electrophotographic photosensitive member in a portion (second region) having an undercoat layer and a charge transporting layer on a support in this order. In FIG. 2, reference numeral 101 denotes a support, reference numeral 102 denotes an undercoat layer, and reference numeral 104 denotes a charge transporting layer.

Figure 3:
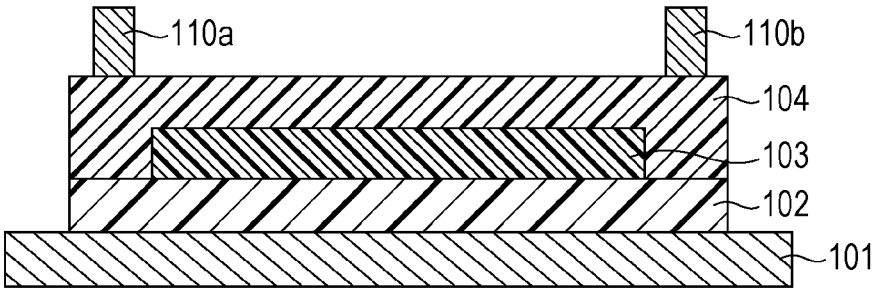
FIG. 3 is a diagram showing an example of a positional relationship between the layer configuration of an electrophotographic photosensitive member and a gap retaining member.

FIG. 3 is a diagram showing an example of a positional relationship between the layer configuration of an electrophotographic photosensitive member and a gap retaining member. In FIG. 3, the electrophotographic photosensitive member includes the first region in which the undercoat layer 102, the charge generating layer 103, and the charge transporting layer 104 are disposed on the support 101 in this order and the second region in which the undercoat layer 102 and the charge transporting layer 104 are disposed on the support 101 in this order. The surface of the second region of the electrophotographic photosensitive member comes into contact with gap retaining members 110*a* and 110*b*.

In general, a cylindrical electrophotographic photosensitive member in which a charge generating layer and a charge transporting layer are disposed on a cylindrical support is widely used as the electrophotographic photosensitive member. However, the shapes of a belt, a sheet, and the like may be employed.

Process Cartridge and Electrophotographic Apparatus

Figure 4:
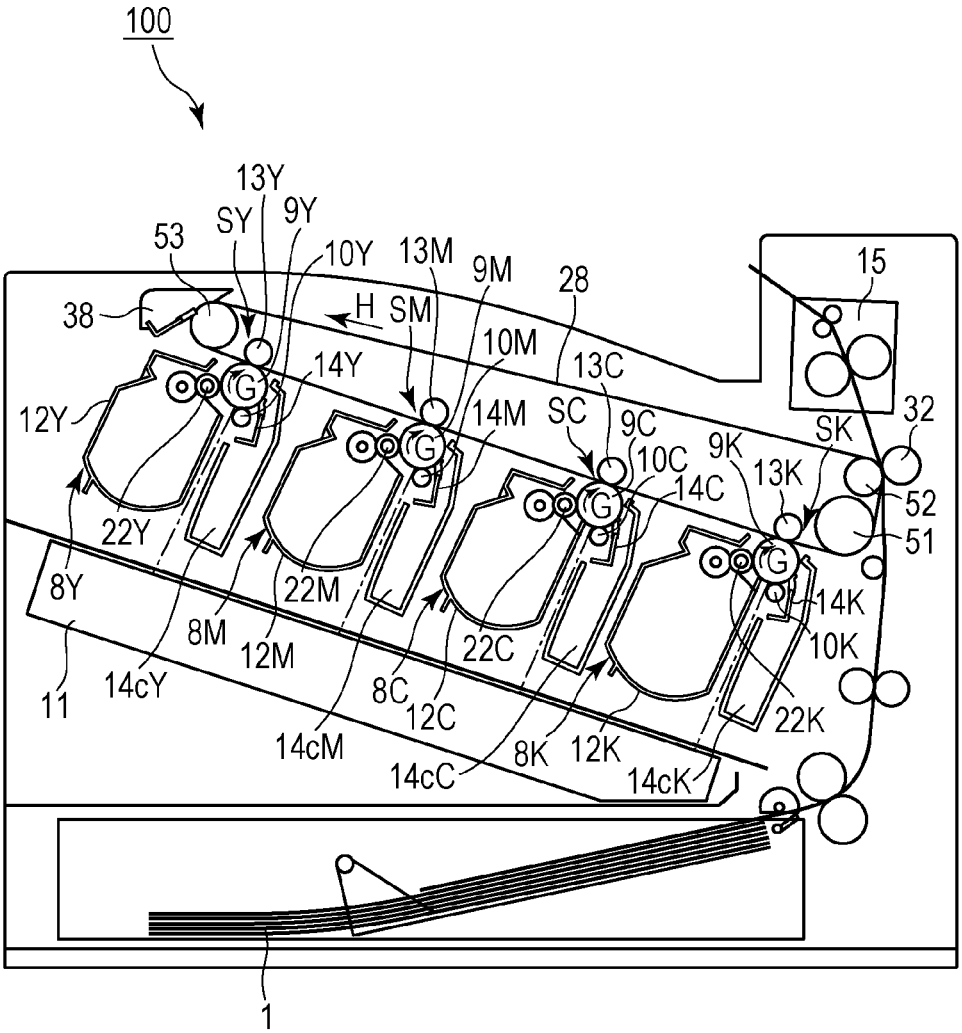
FIG. 4 is a diagram schematically showing a cross-section of an electrophotographic apparatus.

The whole configuration of the electrophotographic apparatus according to aspects of the present invention will be described. FIG. 4 is a diagram schematically showing a cross-section of an electrophotographic apparatus 100 according to an embodiment of the present invention.

The electrophotographic apparatus 100 has first, second, third, and fourth image forming portions SY, SM, SC, and SK, respectively, as a plurality of image forming portions to form images of yellow (Y), magenta (M), cyan (C), and black (K), respectively. In FIG. 4, the first to fourth image forming portions SY, SM, SC, and SK are arranged in a row in the direction intersecting the vertical direction.

In the electrophotographic apparatus according to aspects of the present invention, The configurations and the operations of the first to fourth image forming portions are substantially the same except that the colors of the resulting images are different. Therefore, in the following cases where differentiation is not particularly required, Y, M, C, and K are omitted and explanations will be made as a whole.

The electrophotographic apparatus 100 includes four electrophotographic photosensitive members 9 (9Y, 9M, 9C, 9K) arranged side by side in the direction intersecting the vertical direction. The electrophotographic photosensitive members 9 are rotated in the directions indicated by arrows G shown in the drawing. Charge rollers 10 (10Y, 10M, 10C, 10K) and a scanner unit (exposure apparatus) 11 are arranged around the electrophotographic photosensitive members 9.

The electrophotographic photosensitive members 9 are image bearing members to bear toner images. The charge rollers 10 are charging devices to uniformly charge the surfaces of the electrophotographic photosensitive members 9. The scanner unit (exposure apparatus) 11 is an exposure device to apply laser on the basis of the image information and form electrostatic latent images on the electrophotographic photosensitive members 9. In addition, developing units 12 and cleaning blades 14 (14Y, 14M, 14C, 14K) are arranged around the electrophotographic photosensitive members 9.

The developing units 12 (12Y, 12M, 12C, 12K) are developing devices to develop electrostatic latent images as toner images. The cleaning blades 14 are cleaning devices to remove toner remaining on the surface of the electrophotographic photosensitive members 9 after transfer (transfer-residual toner). In addition, an intermediate transfer belt 28 serving as an intermediate transfer member to transfer the toner images on the electrophotographic photosensitive members 9 to a transfer medium 1 is arranged opposing to the four electrophotographic photosensitive members 9.

In the electrophotographic apparatus according to aspects of the present invention, the electrophotographic photosensitive member 9, the charge roller 10, the developing unit 12, and the cleaning blade 14 are integrated as a cartridge to form process cartridges 8 (8Y, 8M, 8C, 8K). The process cartridges 8 are detachably mountable to the electrophotographic apparatus 100 through fitting devices, e.g., fitting guides and positioning members, although not shown in the drawing, disposed in the electrophotographic apparatus main body.

In FIG. 4, the process cartridge 8 for each color has the same shape, and the toners of the individual colors of yellow (Y), magenta (M), cyan (C), and black (K) are accommodated in the process cartridges 8 of the respective colors. The intermediate transfer belt 28 comes into contact with the above-described four electrophotographic photosensitive members 9 and is rotated in the direction indicated by an arrow H shown in the drawing.

The intermediate transfer belt 28 is looped over a plurality of support members (driving roller 51, opposing roller for secondary-transfer 52, driven roller 53). Four primary transfer rollers 13 (13Y, 13M, 13C, 13K) serving as primary transfer devices are aligned on the inner peripheral surface side of the intermediate transfer belt 28 in such a way as to oppose to the individual electrophotographic photosensitive members 9. A secondary transfer roller 32 serving as a secondary transfer device is arranged at the position opposing to the opposing roller for secondary-transfer 52 on the outer peripheral surface of the intermediate transfer belt 28.

In the image-forming period, the surfaces of the electrophotographic photosensitive members 9 are uniformly charged with the charge rollers 10. The charged surfaces of the electrophotographic photosensitive members 9 are scanning-exposed by laser light emitted from the scanner unit 11 in accordance with the image information, so that electrostatic latent images in accordance with the image information are formed on the electrophotographic photosensitive members 9. The electrostatic latent images formed on the electrophotographic photosensitive members 9 are developed as toner images with the developing units 12. The toner images borne on the electrophotographic photosensitive members 9 are transferred to the intermediate transfer belt 28 with the primary transfer rollers 13 (primary transfer).

In the full color image-forming period, the above-described process is performed in the first to fourth image forming portions SY, SM, SC, and SK sequentially, and the toner images of the individual colors are sequentially superimposed and primarily transferred to the intermediate transfer belt 28. Thereafter, the transfer medium 1 is carried to a secondary transfer portion in synchronization with the movement of the intermediate transfer belt 28. The four-color toner image on the intermediate transfer belt 28 is secondarily transferred to the transfer medium 1 at a time by the action of the secondary transfer roller 32 in contact with the intermediate transfer belt 28 with the transfer medium 1 therebetween.

The transfer medium 1 with the transferred toner image is carried to a fixing apparatus 15 serving as a fixing device. In the fixing apparatus 15, heat and pressure are applied to the transfer medium 1, so that the toner image is fixed to the transfer medium 1. Meanwhile, the primary-transfer remaining toner, which remains on the electrophotographic photosensitive members 9 after the primary transfer step, is removed with cleaning blades 14 and is recovered into removal toner chambers 14*c* (14*c*Y, 14*c*M, 14*c*C, 14*c*K). The secondary-transfer remaining toner, which remains on the intermediate transfer belt 28 after the secondary transfer step, is removed with an intermediate transfer belt cleaning device 38.

The electrophotographic apparatus 100 may form a monochrome or multicolor image by using only predetermined at least one (not all) image forming portion.

The gap retaining member is a member to retain a constant distance between the electrophotographic photosensitive member and the charging member or the developer bearing member. For example, a gap retaining member, which retains the distance from the photosensitive member to perform slide-rubbing of the photosensitive member surface with a charge brush used in the case where the charging method is a contact injection charging system, is mentioned. Also, a gap retaining member, which enhances outside shape run-out precision to uniformly charge the photosensitive member with a charge roller used in the case of noncontact charging, is mentioned. Also, a gap retaining member, which controls supply of a developer to the photosensitive member by adjusting the contact pressure (contact force) between the photosensitive member and a developing roller used in the case where the developing method is a contact developing system, and a gap retaining member, which retains the constant distance between the photosensitive member and the developing sleeve used in the case of noncontact development, are mentioned.

A cylindrical member having a predetermined thickness and the like are used as the gap retaining member. Examples of materials for the gap retaining member include polyolefin resins, e.g., polyethylene, polyester resins, e.g., polyethylene terephthalate (PET), fluorine based resins, e.g., polytetrafluoroethylene (PTFE), and acetal resins, e.g., polyoxymethylene (POM). Also, examples include rubbers, e.g., polyisoprene rubber (natural rubber), polyurethane rubber, chloroprene rubber, acrylonitrile-butadiene rubber, silicone rubber, and fluororubber. In addition, metals having elasticity, e.g., aluminum, iron, copper, titanium, and alloys containing them as primary components, are mentioned.

Process Cartridge

Figure 5:
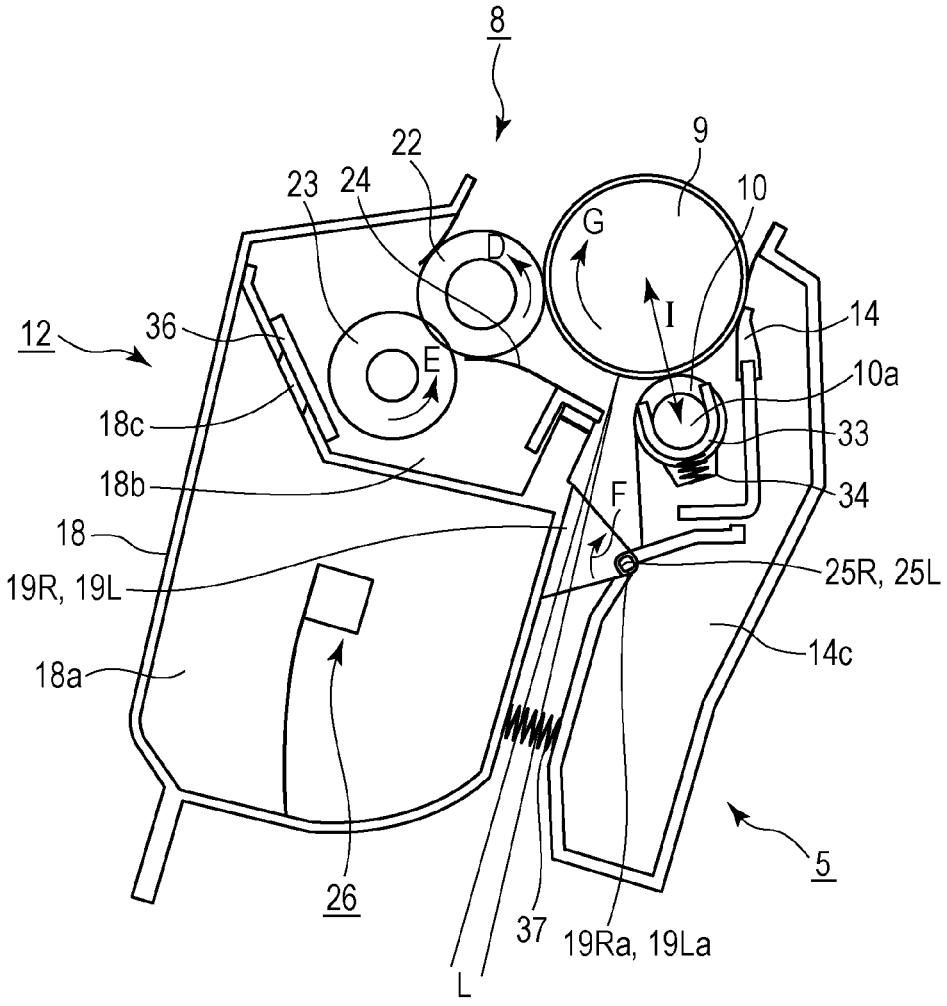
FIG. 5 is a diagram schematically showing a cross-section of a process cartridge.

Next, the whole configuration of the process cartridge 8 fit into the electrophotographic apparatus 100 according to aspects of the present invention will be described with reference to FIG. 5. FIG. 5 is a schematic sectional view of the process cartridge 8 in the state in which the electrophotographic photosensitive member 9 is in contact with the developing roller 22.

The process cartridge 8 includes a cleaning frame 5 provided with the electrophotographic photosensitive member 9 and the like and the developing unit 12 provided with the developing roller 22 and the like. The cleaning frame 5 has a first frame (hereafter referred to as cleaning frame) 5 serving as a frame to support various elements in the cleaning frame 5. The electrophotographic photosensitive member 9 is attached to the cleaning frame 5 with bearing, although not shown in the drawing, therebetween in such a way as to be rotatable in the direction indicated by an arrow G shown in the drawing. The electrophotographic photosensitive member 9 of the cleaning frame 5 is irradiated with laser light L emitted from the scanner unit disposed in the electrophotographic apparatus main body.

Also, the charge roller 10 and the cleaning blade 14 are arranged in the cleaning frame 5 in such a way as to come into contact with the peripheral surface of the electrophotographic photosensitive member 9. The transfer-residual toner removed from the surface of the electrophotographic photosensitive member 9 with the cleaning blade 14 is configured to fall into the removal toner chamber 14*c*. Also, a charge roller bearing 33 is attached to the cleaning frame 5 along the line passing through the rotation center of the charge roller 10 and the rotation center of the electrophotographic photosensitive member 9.

The charge roller bearing 33 is attached in such a way as to be movable in the direction indicated by an arrow I shown in the drawing. The rotating shaft 10*a* of the charge roller 10 is rotatably attached to the charge roller bearing 33. The charge roller bearing 33 is energized toward the electrophotographic photosensitive member 9 with a charge roller pressurizing spring 34 serving as an energizing device.

On the other hand, the developing unit 12 has a developing frame 18 to support various elements in the developing unit 12. The developing roller 22 serving as a developer bearing member, which comes into contact with the electrophotographic photosensitive member 9 and is rotated in the direction indicated by an arrow D shown in the drawing (counterclockwise direction), is disposed in the developing unit 12. The developing roller 22 is rotatably supported by the developing frame 18 at both end portions in the longitudinal direction (direction of rotation axial line) with developing bearings (not shown in the drawing) therebetween. The developing bearing is attached to each of both side portions of the developing frame 18.

The developing unit 12 includes a developer containing chamber (hereafter referred to as toner containing chamber) 18*a* and a developing chamber 18*b* provided with the developing roller 22. An opening 18*c* is disposed in a partition to separate the toner containing chamber 18*a* and the developing chamber 18*b*. In shipment of the process cartridge 8, a developer seal member 36 to prevent scattering of the toner in the toner containing chamber 18*a* to the outside of the process cartridge 8 is disposed on the face of the developing chamber 18*b* side of the opening 18*c*.

After the process cartridge 8 is fit to the electrophotographic apparatus 100, the developer seal member 36 is pulled in the longitudinal direction through the drive line (not shown in the drawing) of the process cartridges 8. Then, the opening 18*c* is opened. In the developing chamber 18*b*, a toner supplying roller 23 serving as a developer feed member, which comes into contact with the developing roller 22 and is rotated in the direction indicated by an arrow E and a developing blade 24 serving as a developer regulating member to regulate the toner layer of the developing roller 22 are arranged. In the toner containing chamber 18*a* of the developing frame 18, an agitation member 26 to agitate the accommodated toner and carry the toner to the above-described toner supplying roller 23 is disposed.

The developing unit 12 is bonded to the cleaning frame 5 in such a way as to be pivotable around a fitting shaft 25 (25R, 25L) fit into holes 19Ra and 19La disposed in a bearing members 19R and 19L. The developing unit 12 is energized by a pressurizing spring 37. Consequently, in the image-forming period of the process cartridge 8, the developing unit 12 is rotated around the fitting shaft 25 in the direction indicated by an arrow F, and the electrophotographic photosensitive member 9 comes into contact with the developing roller 22.

EXAMPLES

Aspects of the present invention will be described below in further detail with reference to the examples, although these examples are not seen to be limiting. In this regard, the term "part" in the examples refers to "part by mass".

Example 1

A support (conductive support) was specified to be an aluminum cylinder (JIS-A3003, aluminum alloy) having a length of 260.5 mm and a diameter of 30 mm.

Thereafter, 100 parts of zinc oxide particle (average primary particle diameter: 50 nm, specific surface area: 19 $m^2/g$, produced by TAYCA CORPORATION) was mixed into 500 parts of toluene while agitation was performed. This was mixed with 1.25 parts of N-2-(aminoethyl)-3-aminopropylmethyldimethoxysilane (trade name: KBM602, produced by Shin-Etsu Chemical Co., Ltd.) serving as a surface-treatment agent while agitation was performed for 2 hours. Subsequently, toluene was removed by distillation under reduced pressure, and drying was performed at 120° C. for 3 hours, so that zinc oxide particle whose surface has been treated with a silane coupling agent were obtained.

A dispersion was prepared by adding 75 parts of zinc oxide particle whose surface has been treated with a silane coupling agent, 16 parts of isocyanate compound having a block isocyanate group represented by Formula (3) below, 9 parts of polyvinylbutyral resin (trade name: S-LEC BM-1 (produced by Sekisui Chemical Co., Ltd.), and 1 part of 2,3,4-trihydroxybenzophenone (produced by TOKYO KASEI KOGYO CO., LTD.)

to a mixed solvent of 60 parts of methyl ethyl ketone and 60 parts of 1-butanol.

(3)

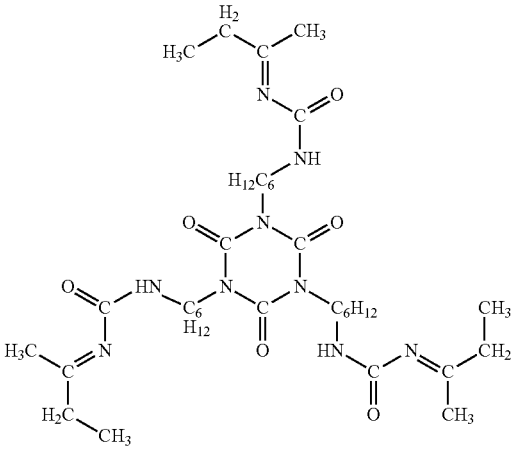

The resulting dispersion was subjected to a dispersion treatment by using glass beads having an average particle diameter of 1.0 mm with a vertical sand mill in an atmosphere at 23° C. for 3 hours at the number of revolutions of 1,500 rpm. After the dispersion treatment, a coating liquid for undercoat layer was prepared by adding 5 parts of cross-linked polymethyl methacrylate particles (trade name: SSX-103, average particle diameter: 3 μm, produced by Sekisui Chemical Co., Ltd.) and 0.01 parts of silicone oil (trade name: SH28PA, produced by Dow Corning Toray Silicone Co., Ltd.) to the resulting dispersion and performing agitation. A support was dip-coated with the resulting coating liquid for undercoat layer to form a coating film, and the coating film was heated at 170° C. for 30 minutes to cause polymerization, so that an undercoat layer having a film thickness of 30 μm was formed.

In formation of the coating film, dip coating was performed by dipping the support excluding a 3-mm region from the end portion on the pull-up start side (upper end portion in the vertical direction) into the coating liquid and, thereafter, pulling up the support from the coating liquid relatively, so that the undercoat layer was not formed in the 3-mm region from the end portion on the pull-up start side. Meanwhile, after the support was pulled up from the coating liquid and before the coating liquid was dried, in a 3-mm region from the end portion on the pull-up finish side (lower end portion in the vertical direction), the coating film applied to the outer peripheral surface of the support was wiped with lens-cleaning paper impregnated with a solvent, so that the coating film was peeled. Consequently, the undercoat layer was not formed in the 3-mm region from the end portion on the pull-up finish side (lower end portion in the vertical direction).

Subsequently, a hydroxygallium phthalocyanine crystal (charge generating substance) with a crystal form exhibiting peaks at 7.5°, 9.9°, 12.5°, 16.3°, 18.6°, 25.1°, and 28.3° which were Bragg angle (2θ±0.2°) in CuKα characteristic X-ray diffraction was prepared. A sand mill by using glass beads having a diameter of 1 mm was charged with 10 parts of the resulting hydroxygallium phthalocyanine crystal, 5 parts of butyral resin (trade name: S-LEC BX-1, produced by Sekisui Chemical Co., Ltd.), and 260 parts of cyclohexanone and a dispersion treatment was performed for 1.5 hours. A coating liquid for charge generating layer was prepared by adding 240 parts of ethyl acetate thereto. The undercoat layer was dip-coated with the resulting coating liquid for charge generating layer to form a coating film, and the resulting coating film was dried at 80° C. for 10 minutes to form a charge generating layer having a film thickness of 0.20 μm.

In formation of this coating film, dip coating was performed by dipping the support excluding a 15-mm region from the end portion on the pull-up start side into the coating liquid and, thereafter, pulling up the support from the coating liquid relatively, so that the charge generating layer was not formed in the 15-mm region from the end portion on the pull-up start side. Meanwhile, after the support was pulled up from the coating liquid and before the coating liquid was dried, in a 15-mm region from the end portion on the pull-up finish side, the coating film applied to the outer peripheral surface of the support was wiped with lens-cleaning paper impregnated with a solvent, so that the coating film was peeled. Consequently, the charge generating layer was not formed in the 15-mm region from the end portion on the pull-up finish side.

Next, 7 parts of amine compound, represented by Formula (4) below, serving as a charge transporting substance and 10 parts of polycarbonate resin having a structural unit represented by Formula (1-6) above and having a weight average molecular weight of 50,000 were dissolved into a mixed solvent of 30 parts of dimethoxymethane and 70 parts of chlorobenzene, so that a coating liquid for charge transporting layer was prepared. The charge generating layer was dip-coated with the resulting coating liquid for charge transporting layer to form a coating film, and the resulting coating film was dried at 120° C. for 60 minutes to form a charge transporting layer having a film thickness of 20 μm.

In formation of this coating film, dip coating was performed by dipping the support excluding a 3-mm region from the end portion on the pull-up start side into the coating liquid and, thereafter, pulling up the support from the coating liquid relatively, so that the charge transporting layer was not formed in the 3-mm region from the end portion on the pull-up start side. Meanwhile, after the support was pulled up from the coating liquid and before the coating liquid was dried, in a 3-mm region from the end portion on the pull-up finish side, the coating film applied to the outer peripheral surface of the support was wiped with lens-cleaning paper impregnated with a solvent, so that the coating film was peeled. Consequently, the charge transporting layer was not formed in the 3-mm region from the end portion on the pull-up finish side.

(4)

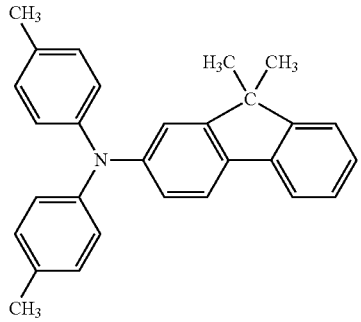

In this manner, an electrophotographic photosensitive member including the undercoat layer, the charge generating layer, and the charge transporting layer on the support was produced. The first region of the electrophotographic photosensitive member was a region from the position at 15 mm to the position at 245.5 mm from one end side of the support. The second regions of the electrophotographic photosensitive member were a region from the position at 3 mm to the position at 15 mm from the one end side of the support and a region from the position at 245.5 mm to the position at 257.5 mm from the one end side of the support.

Evaluation of Adhesive Force

A laser beam printer (trade name: HP LaserJet Enterprise600 M603, noncontact developing system, print speed: A4 portrait orientation 60 sheets/min) produced by Hewlett-Packard Company was modified as an evaluation machine and the adhesive force was evaluated. The produced electrophotographic photosensitive member was fit to a process cartridge for HP LaserJet Enterprise600 M603. In order to retain a distance between the electrophotographic photosensitive member and a developer bearing member, rotatable cylindrical POM gap retaining members having a width of 4 mm were allowed to come into contact centering the positions at about 9 mm from one end side and the other end side of the support. The contact force was specified to be 30 N. The image forming region of the electrophotographic photosensitive member fit to the process cartridge was specified to be a region from the position at 20 mm from one end side of the support to the position at 240.5 mm from the one end side of the support. Therefore, the non-image forming regions were a region from the position at 0 mm to the position at 20 mm from the one end side of the support and a region from the position at 240.5 mm to the position at 260.5 mm from the one end side of the support. Then, it was ascertained that the gap retaining member came into contact with the surface of the second region of the electrophotographic photosensitive member.

The adhesive force was evaluated as described below. In an environment at a temperature of 15° C. and a humidity of 10% RH, 50,000 sheets of images were formed with A4 sized normal paper at a printing rate of 1% in an intermittent mode in which stopping was performed every two sheets of image formation. After 50,000 sheets of images were formed, the adhesive state between the surface layer (charge transporting layer) of the electrophotographic photosensitive member and the undercoat layer in the second region was examined. As for the adhesive state, the electrophotographic photosensitive member was detached from the process cartridge in such a way that no damage was caused, and the peeling state of the charge transporting layer was visually evaluated. The criteria of the visual inspection were as described below. The results are shown in Table 1.

A: no change was observed in the film and, therefore, good

B: floating of the photosensitive layer in the film was slightly observed

C: floating of the photosensitive layer in the film was clearly observed, although peeling was not reached D: peeling of the film was observed

Example 2

An electrophotographic photosensitive member was produced in the same manner as in Example 1 except that the polycarbonate resin in Example 1 was changed to a polycarbonate resin having a ratio of the structural unit represented by Formula (1-1) above to the structural unit represented by Formula (1-5) above of 6/4 (molar ratio) and a weight average molecular weight of 50,000. The adhesive force was evaluated in the same manner. The results are shown in Table 1.

Example 3

An electrophotographic photosensitive member was produced in the same manner as in Example 1 except that the polycarbonate resin in Example 1 was changed to a polycarbonate resin having a ratio of the structural unit represented by Formula (1-3) above to the structural unit represented by Formula (1-7) above of 5/5 (molar ratio) and a weight average molecular weight of 70,000. The adhesive force was evaluated in the same manner. The results are shown in Table 1.

Example 4

An electrophotographic photosensitive member was produced in the same manner as in Example 1 except that the polycarbonate resin in Example 1 was changed to a polyester resin having a ratio of the structural unit represented by Formula (2-1) above to the structural unit represented by Formula (2-2) above of 5/5 (molar ratio) and a weight average molecular weight of 100,000. The adhesive force was evaluated in the same manner. The results are shown in Table 1.

Example 5

An electrophotographic photosensitive member was produced in the same manner as in Example 1 except that the polycarbonate resin in Example 1 was changed to a polyester resin having the structural unit represented by Formula (2-5) above and a weight average molecular weight of 100,000. The evaluation was performed in the same manner. The results are shown in Table 1.

Examples 6 to 10

The adhesive forces were evaluated in the same manner as in Examples 1 to 5 except that the contact forces of the gap retaining members in contact with the second regions of the electrophotographic photosensitive members in Examples 1 to 5 were specified to be 10 N. The results are shown in Table 1.

Examples 11 to 20

Electrophotographic photosensitive members were produced in the same manner as in Examples 1 to 10 except that the zinc oxide particle whose surface has been treated with the silane coupling agent of the coating liquid for undercoat layer used in Examples 1 to 10 were changed to a titanium oxide particle whose surface has been treated with γ-aminopropyltrimethoxysilane. The adhesive forces were evaluated in the same manner as in Example 1. The results are shown in Table 1.

TABLE 1

| Example | Surface layer Resin | Undercoat layer Metal oxide | Undercoat layer Resin | Gap retaining member Width/mm | Gap retaining member Contact force/N | Adhesive force evaluation 50,000 sheets |
|---|---|---|---|---|---|---|
| 1 | polycarbonate resin (1-6) | zinc oxide | urethane | 4 | 30 | A |
| 2 | copolymer (6/4) of polycarbonate resins (1-1) and (1-5) | zinc oxide | urethane | 4 | 30 | A |
| 3 | copolymer (5/5) of polycarbonate resins (1-3) and (1-7) | zinc oxide | urethane | 4 | 30 | A |
| 4 | copolymer (5/5) of polyester resins (2-1) and (2-2) | zinc oxide | urethane | 4 | 30 | A |
| 5 | polyester resin (2-5) | zinc oxide | urethane | 4 | 30 | A |
| 6 | polycarbonate resin (1-6) | zinc oxide | urethane | 4 | 10 | A |
| 7 | copolymer (6/4) of polycarbonate resins (1-1) and (1-5) | zinc oxide | urethane | 4 | 10 | A |
| 8 | copolymer (5/5) of polycarbonate resins (1-3) and (1-7) | zinc oxide | urethane | 4 | 10 | A |
| 9 | copolymer (5/5) of polyester resins (2-1) and (2-2) | zinc oxide | urethane | 4 | 10 | A |
| 10 | polyester resin (2-5) | zinc oxide | urethane | 4 | 10 | A |
| 11 | polycarbonate resin (1-6) | titanium oxide | urethane | 4 | 30 | A |
| 12 | copolymer (6/4) of polycarbonate resins (1-1) and (1-5) | titanium oxide | urethane | 4 | 30 | A |
| 13 | copolymer (5/5) of polycarbonate resins (1-3) and (1-7) | titanium oxide | urethane | 4 | 30 | A |
| 14 | copolymer (5/5) of polyester resins (2-1) and (2-2) | titanium oxide | urethane | 4 | 30 | A |
| 15 | polyester resin (2-5) | titanium oxide | urethane | 4 | 30 | A |
| 16 | polycarbonate resin (1-6) | titanium oxide | urethane | 4 | 10 | A |
| 17 | copolymer (6/4) of polycarbonate resins (1-1) and (1-5) | titanium oxide | urethane | 4 | 10 | A |
| 18 | copolymer (5/5) of polycarbonate resins (1-3) and (1-7) | titanium oxide | urethane | 4 | 10 | A |
| 19 | copolymer (5/5) of polyester resins (2-1) and (2-2) | titanium oxide | urethane | 4 | 10 | A |
| 20 | polyester resin (2-5) | titanium oxide | urethane | 4 | 10 | A |

Examples 21 to 25

Electrophotographic photosensitive members were produced in the same manner as in Examples 1 to 5 except that the support (aluminum cylinder) in Examples 1 to 5 was changed to aluminum cylinder (JIS-A3003, aluminum alloy) having a length of 261.6 mm and a diameter of 24 mm.

The first region of the electrophotographic photosensitive member was a region from the position at 15 mm to the position at 246.6 mm from one end side of the support. The second regions of the electrophotographic photosensitive member were a region from the position at 3 mm to the position at 15 mm from the one end side of the support and a region from the position at 246.6 mm to the position at 258.6 mm from the one end side of the support.

Evaluation of Adhesive Force

A laser beam printer (trade name: HP LaserJet Enterprise 500 Color M551, contact developing system, print speed: A4 portrait orientation 30 sheets/min) produced by Hewlett-Packard Company was modified as an evaluation machine and the adhesive force was evaluated. The produced electrophotographic photosensitive member was fit to a process cartridge for HP LaserJet Enterprise 500 Color M551. In order to retain a distance between the electrophotographic photosensitive member and a developer bearing member, rotatable cylindrical POM gap retaining members having a width of 2 mm were allowed to come into contact centering the positions at about 9 mm from one end side and the other end side of the support. The contact force was specified to be 10 N. The image forming region of the electrophotographic photosensitive member fit to the process cartridge was specified to be a region from the position at 20 mm from one end side of the support to the position at 241.6 mm from the one end side of the support. Therefore, the non-image forming regions were a region from the position at 0 mm to the position at 20 mm from the one end side of the support and a region from the position at 241.6 mm to the position at 261.6 mm from the one end side of the support. Then, it was ascertained that the gap retaining member came into contact with the surface of the second region of the electrophotographic photosensitive member.

The adhesive force was evaluated as described below. In an environment at a temperature of 15° C. and a humidity of 10% RH, 25,000 sheets of images were formed with A4 sized normal paper at a printing rate of 1% in an intermittent mode in which stopping was performed every two sheets of image formation. After 25,000 sheets of images were formed, the adhesive state between the surface layer (charge transporting layer) of the electrophotographic photosensitive member and the undercoat layer in the second region was examined.

As for the adhesive state, the electrophotographic photosensitive member was detached from the process cartridge in such a way that no damage was caused, and the peeling state of the charge transporting layer was visually evaluated. The criteria of the visual inspection were as described below. The results are shown in Table 2.

A: no change was observed in the film and, therefore, good

B: floating of the photosensitive layer in the film was slightly observed

C: floating of the photosensitive layer in the film was clearly observed, although peeling was not reached D: peeling of the film was observed Examples 26 to 30

The adhesive forces were evaluated in the same manner as in Examples 21 to 25 except that the contact forces of the gap retaining members in contact with the second regions of the electrophotographic photosensitive members in Examples 21 to 25 were specified to be 3 N. The results are shown in Table 2.

Examples 31 to 40

Electrophotographic photosensitive members were produced in the same manner as in Examples 21 to 30 except that the zinc oxide particle whose surface has been treated with the silane coupling agent of the coating liquid for undercoat layer used in Examples 21 to 30 were changed to a titanium oxide particle whose surface has been treated with γ-aminopropyltrimethoxysilane. The adhesive forces were evaluated in the same manner as in Example 21. The results are shown in Table 2.

TABLE 2

| | | Undercoat layer | | Gap retaining member | | Adhesive force |
|---|---|---|---|---|---|---|
| Example | Surface layer Resin | Metal oxide | Resin | Width/ mm | Contact force/N | evaluation 25,000 sheets |
| 21 | polycarbonate resin (1-6) | zinc oxide | urethane | 2 | 10 | A |
| 22 | copolymer (6/4) of polycarbonate resins (1-1) and (1-5) | zinc oxide | urethane | 2 | 10 | A |
| 23 | copolymer (5/5) of polycarbonate resins (1-3) and (1-7) | zinc oxide | urethane | 2 | 10 | A |
| 24 | copolymer (5/5) of polyester resins (2-1) and (2-2) | zinc oxide | urethane | 2 | 10 | A |
| 25 | polyester resin (2-5) | zinc oxide | urethane | 2 | 10 | A |
| 26 | polycarbonate resin (1-6) | zinc oxide | urethane | 2 | 3 | A |
| 27 | copolymer (6/4) of polycarbonate resins (1-1) and (1-5) | zinc oxide | urethane | 2 | 3 | A |
| 28 | copolymer (5/5) of polycarbonate resins (1-3) and (1-7) | zinc oxide | urethane | 2 | 3 | A |
| 29 | copolymer (5/5) of polyester resins (2-1) and (2-2) | zinc oxide | urethane | 2 | 3 | A |
| 30 | polyester resin (2-5) | zinc oxide | urethane | 2 | 3 | A |
| 31 | polycarbonate resin (1-6) | titanium oxide | urethane | 2 | 10 | A |
| 32 | copolymer (6/4) of polycarbonate resins (1-1) and (1-5) | titanium oxide | urethane | 2 | 10 | A |
| 33 | copolymer (5/5) of polycarbonate resins (1-3) and (1-7) | titanium oxide | urethane | 2 | 10 | A |
| 34 | copolymer (5/5) of polyester resins (2-1) and (2-2) | titanium oxide | urethane | 2 | 10 | A |
| 35 | polyester resin (2-5) | titanium oxide | urethane | 2 | 10 | A |
| 36 | polycarbonate resin (1-6) | titanium oxide | urethane | 2 | 3 | A |
| 37 | copolymer (6/4) of polycarbonate resins (1-1) and (1-5) | titanium oxide | urethane | 2 | 3 | A |
| 38 | copolymer (5/5) of polycarbonate resins (1-3) and (1-7) | titanium oxide | urethane | 2 | 3 | A |
| 39 | copolymer (5/5) of polyester resins (2-1) and (2-2) | titanium oxide | urethane | 2 | 3 | A |
| 40 | polyester resin (2-5) | titanium oxide | urethane | 2 | 3 | A |

Examples 41 and 42

Electrophotographic photosensitive members were produced in the same manner as in Example 1 except that 16 parts of isocyanate compound having a block isocyanate group represented by Formula (3) above of the coating liquid for undercoat layer used in Examples 1 and 21 was changed to 21.3 parts of solution (trade name: Sumidur BL3175, solid content 75%, produced by Sumika Bayer Urethane Co., Ltd.) containing an isocyanate compound having a block isocyanate group represented by Formula (3) above. The adhesive forces were evaluated in the same manner as in Example 21. The results are shown in Table 3.

TABLE 3

| | | Undercoat layer | | Gap retaining member | | Adhesive force |
|---|---|---|---|---|---|---|
| Example | Surface layer Resin | Metal oxide | Resin | Width/ mm | Contact force/N | evaluation 50,000 sheets |
| 41 | polycarbonate resin (1-6) | zinc oxide | urethane | 4 | 30 | A |
| 42 | polycarbonate resin (1-6) | zinc oxide | urethane | 2 | 10 | A |

Example 101

A support (conductive support) was specified to be an aluminum cylinder (JIS-A3003, aluminum alloy) having a length of 260.5 mm and a diameter of 30 mm.

Thereafter, 100 parts of zinc oxide particle (average primary particle diameter: 50 nm, specific surface area: 19 $m^2/g$, produced by TAYCA CORPORATION) was mixed into 500 parts of toluene while agitation was performed. This was mixed with 1.25 parts of N-2-(aminoethyl)-3-aminopropylmethyldimethoxysilane (trade name: KBM602, produced by Shin-Etsu Chemical Co., Ltd.) serving as a surface-treatment agent while agitation was performed for 2 hours. Subsequently, toluene was removed by distillation under reduced pressure, and drying was performed at 120° C. for 3 hours, so that zinc oxide particle whose surface has been treated with a silane coupling agent were obtained.

A dispersion was prepared by adding 50 parts of the zinc oxide particle whose surface has been treated with a silane coupling agent, 50 parts of solution (trade name: J-820-60, solid content 60%, produced by DIC Corporation) containing a triazine compound having a butyl-etherified methylol group represented by Formula (5) below, 20 parts of alkyd resin (trade name: M-6405-50, solid content 50%, produced by DIC Corporation), and 1 part of 2,3,4-trihydroxybenzophenone (produced by TOKYO KASEI KOGYO CO., LTD.) to a mixed solvent of 60 parts of methyl ethyl ketone and 60 parts of 1-butanol.

(5)

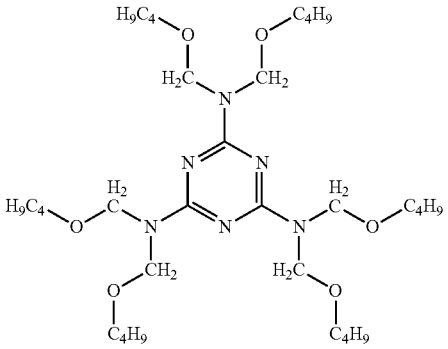

The resulting dispersion was subjected to a dispersion treatment by using glass beads having an average particle diameter of 1.0 mm with a vertical sand mill in an atmosphere at 23° C. for 3 hours at the number of revolutions of 1,500 rpm. After the dispersion treatment, a coating liquid for undercoat layer was prepared by adding 5 parts of cross-linked polymethyl methacrylate particles (trade name: SSX-103, average particle diameter: 3 μm) and 0.01 parts of silicone oil (trade name: SH28PA) to the resulting dispersion and performing agitation. A support was dip-coated with the resulting coating liquid for undercoat layer to form a coating film, the coating film was heated at 170° C. for 30 minutes to cause polymerization, so that an undercoat layer having a film thickness of 30 μm was formed.

In formation of the coating film, dip coating was performed by dipping the support excluding a 3-mm region from the end portion on the pull-up start side (upper end portion in the vertical direction) into the coating liquid and, thereafter, pulling up the support from the coating liquid relatively, so that the undercoat layer was not formed in the 3-mm region from the end portion on the pull-up start side. Meanwhile, after the support was pulled up from the coating liquid and before the coating liquid was dried, in a 3-mm region from the end portion on the pull-up finish side (lower end portion in the vertical direction), the coating film applied to the outer peripheral surface of the support was wiped with lens-cleaning paper impregnated with a solvent, so that the coating film was peeled. Consequently, the undercoat layer was not formed in the 3-mm region from the end portion on the pull-up finish side (lower end portion in the vertical direction).

Subsequently, a hydroxygallium phthalocyanine crystal (charge generating substance) with a crystal form exhibiting peaks at 7.5°, 9.9°, 12.5°, 16.3°, 18.6°, 25.1°, and 28.3° which were Bragg angle (2θ±0.2°) in CuKα characteristic X-ray diffraction was prepared. A sand mill by using glass beads having a diameter of 1 mm was charged with 10 parts of the resulting hydroxygallium phthalocyanine crystal, 5 parts of butyral resin (trade name: S-LEC BX-1), and 260 parts of cyclohexanone and a dispersion treatment was performed for 1.5 hours. A coating liquid for charge generating layer was prepared by adding 240 parts of ethyl acetate thereto. The undercoat layer was dip-coated with the resulting coating liquid for charge generating layer to form a coating film, and the resulting coating film was dried at 80° C. for 10 minutes to form a charge generating layer having a film thickness of 0.20 μm.

In formation of this coating film, dip coating was performed by dipping the support excluding a 15-mm region from the end portion on the pull-up start side into the coating liquid and, thereafter, pulling up the support from the coating liquid relatively, so that the charge generating layer was not formed in the 15-mm region from the end portion on the pull-up start side. Meanwhile, after the support was pulled up from the coating liquid and before the coating liquid was dried, in a 15-mm region from the end portion on the pull-up finish side, the coating film applied to the outer peripheral surface of the support was wiped with lens-cleaning paper impregnated with a solvent, so that the coating film was peeled. Consequently, the charge generating layer was not formed in the 15-mm region from the end portion on the pull-up finish side.

Next, 7 parts of amine compound, represented by Formula (4) below, serving as a charge transporting substance and 10 parts of polycarbonate resin having a structural unit represented by Formula (1-6) above and having a weight average molecular weight of 50,000 were dissolved into a mixed solvent of 30 parts of dimethoxymethane and 70 parts of chlorobenzene, so that a coating liquid for charge transporting layer was prepared. The charge generating layer was dip-coated with the resulting coating liquid for charge transporting layer to form a coating film, and the resulting coating film was dried at 120° C. for 60 minutes to form a charge transporting layer having a film thickness of 20 μm.

In formation of this coating film, dip coating was performed by dipping the support excluding a 3-mm region from the end portion on the pull-up start side into the coating liquid and, thereafter, pulling up the support from the coating liquid relatively, so that the charge transporting layer was not formed in the 3-mm region from the end portion on the pull-up start side. Meanwhile, after the support was pulled up from the coating liquid and before the coating liquid was dried, in a 3-mm region from the end portion on the pull-up finish side, the coating film applied to the outer peripheral surface of the support was wiped with lens-cleaning paper impregnated with a solvent, so that the coating film was peeled. Consequently, the charge transporting layer was not formed in the 3-mm region from the end portion on the pull-up finish side.

In this manner, an electrophotographic photosensitive member including the undercoat layer, the charge generating layer, and the charge transporting layer on the support was produced. The first region of the electrophotographic photosensitive member was a region from the position at 15 mm to the position at 245.5 mm from one end side of the support. The second regions of the electrophotographic photosensitive member were a region from the position at 3 mm to the position at 15 mm from the one end side of the support and a region from the position at 245.5 mm to the position at 257.5 mm from the one end side of the support.

Evaluation of Adhesive Force

A laser beam printer (trade name: HP LaserJet Enterprise600 M603, noncontact developing system, print speed: A4 portrait orientation 60 sheets/min) produced by Hewlett-Packard Company was modified as an evaluation machine and the adhesive force was evaluated. The produced electrophotographic photosensitive member was fit to a process cartridge for HP LaserJet Enterprise600 M603. In order to retain a distance between the electrophotographic photosensitive member and a developer bearing member, rotatable cylindrical POM gap retaining members having a width of 4 mm were allowed to come into contact centering the positions at about 9 mm from one end side and the other end side of the support. The contact force was specified to be 30 N. The image forming region of the electrophotographic photosensitive member fit to the process cartridge was specified to be a region from the position at 20 mm from one end side of the support to the position at 240.5 mm from the one end side of the support. Therefore, the non-image forming regions were a region from the position at 0 mm to the position at 20 mm from the one end side of the support and a region from the position at 240.5 mm to the position at 260.5 mm from the one end side of the support. Then, it was ascertained that the gap retaining member came into contact with the surface of the second region of the electrophotographic photosensitive member.

The adhesive force was evaluated as described below. In an environment at a temperature of 15° C. and a humidity of 10% RH, 50,000 sheets of images were formed with A4 sized normal paper at a printing rate of 1% in an intermittent mode in which stopping was performed every two sheets of image formation. After 50,000 sheets of images were formed, the adhesive state between the surface layer (charge transporting layer) of the electrophotographic photosensitive member and the undercoat layer in the second region was examined. As for the adhesive state, the electrophotographic photosensitive member was detached from the process cartridge in such a way that no damage was caused, and the peeling state of the charge transporting layer was visually evaluated. The criteria of the visual inspection were as described below. The results are shown in Table 4.

A: no change was observed in the film and, therefore, good

B: floating of the photosensitive layer in the film was slightly observed

C: floating of the photosensitive layer in the film was clearly observed, although peeling was not reached D: peeling of the film was observed Example 102

An electrophotographic photosensitive member was produced in the same manner as in Example 101 except that the polycarbonate resin in Example 101 was changed to a polycarbonate resin having a ratio of the structural unit represented by Formula (1-1) above to the structural unit represented by Formula (1-5) above of 6/4 (molar ratio) and a weight average molecular weight of 50,000. The adhesive force was evaluated in the same manner. The results are shown in Table 4.

Example 103

An electrophotographic photosensitive member was produced in the same manner as in Example 101 except that the polycarbonate resin in Example 101 was changed to a polycarbonate resin having a ratio of the structural unit represented by Formula (1-3) above to the structural unit represented by Formula (1-7) above of 5/5 (molar ratio) and a weight average molecular weight of 70,000. The adhesive force was evaluated in the same manner. The results are shown in Table 4.

Example 104

An electrophotographic photosensitive member was produced in the same manner as in Example 101 except that the polycarbonate resin in Example 101 was changed to a polyester resin having a ratio of the structural unit represented by Formula (2-1) above to the structural unit represented by Formula (2-2) above of 5/5 (molar ratio) and a weight average molecular weight of 100,000. The adhesive force was evaluated in the same manner. The results are shown in Table 4.

Example 105

An electrophotographic photosensitive member was produced in the same manner as in Example 101 except that the polycarbonate resin in Example 101 was changed to a polyester resin having the structural unit represented by Formula (2-5) above and a weight average molecular weight of 100,000. The adhesive force was evaluated in the same manner. The results are shown in Table 4.

Examples 106 to 110

The adhesive forces were evaluated in the same manner as in Examples 101 to 105 except that the contact forces of the gap retaining members in contact with the second regions of the electrophotographic photosensitive members in Examples 101 to 105 were specified to be 10 N. The results are shown in Table 4.

Examples 111 to 120

Electrophotographic photosensitive members were produced in the same manner as in Examples 101 to 110 except that the zinc oxide particle whose surface has been treated with the silane coupling agent of the coating liquid for undercoat layer used in Examples 101 to 110 were changed to a titanium oxide particle whose surface has been treated with γ-aminopropyltrimethoxysilane. The adhesive forces were evaluated in the same manner as in Example 101. The results are shown in Table 4.

TABLE 4

| | | Undercoat layer | | Gap retaining member | | Adhesive force |
|---|---|---|---|---|---|---|
| Example | Surface layer Resin | Metal oxide | Resin | Width/ mm | Contact force/N | evaluation 50,000 sheets |
| 101 | polycarbonate resin (1-6) | zinc oxide | amino | 4 | 30 | C |
| 102 | copolymer (6/4) of polycarbonate resins (1-1) and (1-5) | zinc oxide | amino | 4 | 30 | C |
| 103 | copolymer (5/5) of polycarbonate resins (1-3) and (1-7) | zinc oxide | amino | 4 | 30 | C |
| 104 | copolymer (5/5) of polyester resins (2-1) and (2-2) | zinc oxide | amino | 4 | 30 | B |
| 105 | polyester resin (2-5) | zinc oxide | amino | 4 | 30 | B |
| 106 | polycarbonate resin (1-6) | zinc oxide | amino | 4 | 10 | A |
| 107 | copolymer (6/4) of polycarbonate resins (1-1) and (1-5) | zinc oxide | amino | 4 | 10 | A |
| 108 | copolymer (5/5) of polycarbonate resins (1-3) and (1-7) | zinc oxide | amino | 4 | 10 | A |
| 109 | copolymer (5/5) of polyester resins (2-1) and (2-2) | zinc oxide | amino | 4 | 10 | A |
| 110 | polyester resin (2-5) | zinc oxide | amino | 4 | 10 | A |
| 111 | polycarbonate resin (1-6) | titanium oxide | amino | 4 | 30 | B |
| 112 | copolymer (6/4) of polycarbonate resins (1-1) and (1-5) | titanium oxide | amino | 4 | 30 | B |
| 113 | copolymer (5/5) of polycarbonate resins (1-3) and (1-7) | titanium oxide | amino | 4 | 30 | B |
| 114 | copolymer (5/5) of polyester resins (2-1) and (2-2) | titanium oxide | amino | 4 | 30 | A |
| 115 | polyester resin (2-5) | titanium oxide | amino | 4 | 30 | A |
| 116 | polycarbonate resin (1-6) | titanium oxide | amino | 4 | 10 | A |
| 117 | copolymer (6/4) of polycarbonate resins (1-1) and (1-5) | titanium oxide | amino | 4 | 10 | A |
| 118 | copolymer (5/5) of polycarbonate resins (1-3) and (1-7) | titanium oxide | amino | 4 | 10 | A |
| 119 | copolymer (5/5) of polyester resins (2-1) and (2-2) | titanium oxide | amino | 4 | 10 | A |
| 120 | polyester resin (2-5) | titanium oxide | amino | 4 | 10 | A |

Examples 121 to 125

Electrophotographic photosensitive members were produced in the same manner as in Examples 101 to 105 except that the support (aluminum cylinder) in Examples 101 to 105 was changed to aluminum cylinder (JIS-A3003, aluminum alloy) having a length of 261.6 mm and a diameter of 24 mm.

The first region of the electrophotographic photosensitive member was a region from the position at 15 mm to the position at 246.6 mm from one end side of the support. The second regions of the electrophotographic photosensitive member were a region from the position at 3 mm to the position at 15 mm from the one end side of the support and a region from the position at 246.6 mm to the position at 258.6 mm from the one end side of the support.

Evaluation of Adhesive Force

A laser beam printer (trade name: HP LaserJet Enterprise 500 Color M551, contact developing system, print speed: A4 portrait orientation 30 sheets/min) produced by Hewlett-Packard Company was modified as an evaluation machine and the adhesive force was evaluated. The produced electrophotographic photosensitive member was fit to a process cartridge for HP LaserJet Enterprise 500 Color M551. In order to retain a distance between the electrophotographic photosensitive member and a developer bearing member, rotatable cylindrical POM gap retaining members having a width of 2 mm were allowed to come into contact centering the positions at about 9 mm from one end side and the other end side of the support. The contact force was specified to be 10 N. The image forming region of the electrophotographic photosensitive member fit to the process cartridge was specified to be a region from the position at 20 mm from one end side of the support to the position at 241.6 mm from the one end side of the support. Therefore, the non-image forming regions were a region from the position at 0 mm to the position at 20 mm from the one end side of the support and a region from the position at 241.6 mm to the position at 261.6 mm from the one end side of the support. Then, it was ascertained that in the contact region of the gap retaining member of the electrophotographic photosensitive member, there was a portion in which the electrophotographic photosensitive member included the undercoat layer on the support and the charge transporting layer just above the undercoat layer.

The adhesive force was evaluated as described below. In an environment at a temperature of 15° C. and a humidity of 10% RH, 25,000 sheets of images were formed with A4 sized normal paper at a printing rate of 1% in an intermittent mode in which stopping was performed every two sheets of image formation. After 25,000 sheets of images were formed, the adhesive state between the surface layer (charge transporting layer) of the electrophotographic photosensitive member and the undercoat layer in the second region was examined. As for the adhesive state, the electrophotographic photosensitive member was detached from the process cartridge in such a way that no damage was caused, and the peeling state of the charge transporting layer was visually evaluated. The criteria of the visual inspection were as described below. The results are shown in Table 5.

A: no change was observed in the film and, therefore, good

B: floating of the photosensitive layer in the film was slightly observed

C: floating of the photosensitive layer in the film was clearly observed, although peeling was not reached D: peeling of the film was observed Examples 126 to 130

The adhesive forces were evaluated in the same manner as in Examples 121 to 125 except that the contact forces of the gap retaining members in contact with the second regions of the electrophotographic photosensitive members in Examples 121 to 125 were specified to be 3 N. The results are shown in Table 5.

Examples 131 to 140

Electrophotographic photosensitive members were produced in the same manner as in Examples 121 to 130 except that the zinc oxide particle whose surface has been treated with the silane coupling agent in Examples 121 to 130 were changed to a titanium oxide particle whose surface has been treated with γ-aminopropyltrimethoxysilane. The adhesive forces were evaluated in the same manner as in Example 121. The results are shown in Table 5.

TABLE 5

| | | Undercoat layer | | Gap retaining member | | Adhesive force |
|---|---|---|---|---|---|---|
| Example | Surface layer Resin | Metal oxide | Resin | Width/ mm | Contact force/N | evaluation 25,000 sheets |
| 121 | polycarbonate resin (1-6) | zinc oxide | amino | 2 | 10 | B |
| 122 | copolymer (6/4) of polycarbonate resins (1-1) and (1-5) | zinc oxide | amino | 2 | 10 | B |
| 123 | copolymer (5/5) of polycarbonate resins (1-3) and (1-7) | zinc oxide | amino | 2 | 10 | B |
| 124 | copolymer (5/5) of polyester resins (2-1) and (2-2) | zinc oxide | amino | 2 | 10 | A |
| 125 | polyester resin (2-5) | zinc oxide | amino | 2 | 10 | A |
| 126 | polycarbonate resin (1-6) | zinc oxide | amino | 2 | 3 | A |
| 127 | copolymer (6/4) of polycarbonate resins (1-1) and (1-5) | zinc oxide | amino | 2 | 3 | A |
| 128 | copolymer (5/5) of polycarbonate resins (1-3) and (1-7) | zinc oxide | amino | 2 | 3 | A |
| 129 | copolymer (5/5) of polyester resins (2-1) and (2-2) | zinc oxide | amino | 2 | 3 | A |
| 130 | polyester resin (2-5) | zinc oxide | amino | 2 | 3 | A |
| 131 | polycarbonate resin (1-6) | titanium oxide | amino | 2 | 10 | A |
| 132 | copolymer (6/4) of polycarbonate resins (1-1) and (1-5) | titanium oxide | amino | 2 | 10 | A |
| 133 | copolymer (5/5) of polycarbonate resins (1-3) and (1-7) | titanium oxide | amino | 2 | 10 | A |

TABLE 5-continued

| Example | Surface layer Resin | Undercoat layer Metal oxide | Undercoat layer Resin | Gap retaining member Width/mm | Gap retaining member Contact force/N | Adhesive force evaluation 25,000 sheets |
|---|---|---|---|---|---|---|
| 134 | copolymer (5/5) of polyester resins (2-1) and (2-2) | titanium oxide | amino | 2 | 10 | A |
| 135 | polyester resin (2-5) | titanium oxide | amino | 2 | 10 | A |
| 136 | polycarbonate resin (1-6) | titanium oxide | amino | 2 | 3 | A |
| 137 | copolymer (6/4) of polycarbonate resins (1-1) and (1-5) | titanium oxide | amino | 2 | 3 | A |
| 138 | copolymer (5/5) of polycarbonate resins (1-3) and (1-7) | titanium oxide | amino | 2 | 3 | A |
| 139 | copolymer (5/5) of polyester resins (2-1) and (2-2) | titanium oxide | amino | 2 | 3 | A |
| 140 | polyester resin (2-5) | titanium oxide | amino | 2 | 3 | A |

Example 201

A support (conductive support) was specified to be an aluminum cylinder (JIS-A3003, aluminum alloy) having a length of 260.5 mm and a diameter of 30 mm.

A copolymer polyamide having composition molar ratio of ϵ-caprolactam/bis(4-amino-3-methylcyclohexyl)methane/hexamethylenediamine/decamethylenedicarboxylic acid/octadecamethylenedicarboxylic acid of 60%/15%/5%/15%/5% and 13.5 parts of zinc oxide particle (average primary particle diameter: 50 nm, specific surface area: 19 $m^2/g$, produced by TAYCA CORPORATION) were dispersed into a mixed solution of methanol and butanol to prepare a coating liquid for undercoat layer. A support was dip-coated with the resulting coating liquid for undercoat layer to form a coating film, and the coating film was dried at a temperature of 140° C. for 20 minutes, so that an undercoat layer having a film thickness of 30 μm was formed.

In formation of the coating film, dip coating was performed by dipping the support excluding a 3-mm region from the end portion on the pull-up start side (upper end portion in the vertical direction) into the coating liquid and, thereafter, pulling up the support from the coating liquid relatively, so that the undercoat layer was not formed in the 3-mm region from the end portion on the pull-up start side. Meanwhile, after the support was pulled up from the coating liquid and before the coating liquid was dried, in a 3-mm region from the end portion on the pull-up finish side (lower end portion in the vertical direction), the coating film applied to the outer peripheral surface of the support was wiped with lens-cleaning paper impregnated with a solvent, so that the coating film was peeled. Consequently, the undercoat layer was not formed in the 3-mm region from the end portion on the pull-up finish side (lower end portion in the vertical direction).

Subsequently, a hydroxygallium phthalocyanine crystal (charge generating substance) with a crystal form exhibiting peaks at 7.5°, 9.9°, 12.5°, 16.3°, 18.6°, 25.1°, and 28.3° which were Bragg angle (2θ±0.2°) in CuKα characteristic X-ray diffraction was prepared. A sand mill by using glass beads having a diameter of 1 mm was charged with 10 parts of the resulting hydroxygallium phthalocyanine crystal, 5 parts of butyral resin (trade name: S-LEC BX-1 produced by Sekisui Chemical Co., Ltd.), and 260 parts of cyclohexanone and a dispersion treatment was performed for 1.5 hours. A coating liquid for charge generating layer was prepared by adding 240 parts of ethyl acetate thereto. The undercoat layer was dip-coated with the resulting coating liquid for charge generating layer to form a coating film, and the resulting coating film was dried at 80° C. for 10 minutes to form a charge generating layer having a film thickness of 0.20 μm.

In formation of this coating film, dip coating was performed by dipping the support excluding a 15-mm region from the end portion on the pull-up start side into the coating liquid and, thereafter, pulling up the support from the coating liquid relatively, so that the charge generating layer was not formed in the 15-mm region from the end portion on the pull-up start side. Meanwhile, after the support was pulled up from the coating liquid and before the coating liquid was dried, in a 15-mm region from the end portion on the pull-up finish side, the coating film applied to the outer peripheral surface of the support was wiped with lens-cleaning paper impregnated with a solvent, so that the coating film was peeled. Consequently, the charge generating layer was not formed in the 15-mm region from the end portion on the pull-up finish side.

Next, 7 parts of amine compound, represented by Formula (4) below, serving as a charge transporting substance and 10 parts of polycarbonate resin having a structural unit represented by Formula (1-6) above and having a weight average molecular weight of 50,000 were dissolved into a mixed solvent of 30 parts of dimethoxymethane and 70 parts of chlorobenzene, so that a coating liquid for charge transporting layer was prepared. The charge generating layer was dip-coated with the resulting coating liquid for charge transporting layer to form a coating film, and the resulting coating film was dried at 120° C. for 60 minutes to form a charge transporting layer having a film thickness of 20 μm.

In formation of this coating film, dip coating was performed by dipping the support excluding a 3-mm region from the end portion on the pull-up start side into the coating liquid and, thereafter, pulling up the support from the coating liquid relatively, so that the charge transporting layer was not formed in the 3-mm region from the end portion on the pull-up start side. Meanwhile, after the support was pulled up from the coating liquid and before the coating liquid was dried, in a 3-mm region from the end portion on the pull-up finish side, the coating film applied to the outer peripheral surface of the support was wiped with lens-cleaning paper impregnated with a solvent, so that the coating film was peeled. Consequently, the charge transporting layer was not formed in the 3-mm region from the end portion on the pull-up finish side.

In this manner, an electrophotographic photosensitive member including the undercoat layer, the charge generating layer, and the charge transporting layer on the support was produced. The first region of the electrophotographic photosensitive member was a region from the position at 15 mm to the position at 245.5 mm from one end side of the support. The second regions of the electrophotographic photosensitive member were a region from the position at 3 mm to the position at 15 mm from the one end side of the support and a region from the position at 245.5 mm to the position at 257.5 mm from the one end side of the support.

Evaluation of Adhesive Force

A laser beam printer (trade name: HP LaserJet Enterprise600 M603, noncontact developing system, print speed: A4 portrait orientation 60 sheets/min) produced by Hewlett-Packard Company was modified as an evaluation machine and the adhesive force was evaluated. The produced electrophotographic photosensitive member was fit to a process cartridge for HP LaserJet Enterprise600 M603. In order to retain a distance between the electrophotographic photosensitive member and a developer bearing member, rotatable cylindrical POM gap retaining members having a width of 4 mm were allowed to come into contact centering the positions at about 9 mm from one end side and the other end side of the support. The contact force was specified to be 30 N. The image forming region of the electrophotographic photosensitive member fit to the process cartridge was specified to be a region from the position at 20 mm from one end side of the support to the position at 240.5 mm from the one end side of the support. Therefore, the non-image forming regions were a region from the position at 0 mm to the position at 20 mm from the one end side of the support and a region from the position at 240.5 mm to the position at 260.5 mm from the one end side of the support. Then, it was ascertained that in the non-image forming region of the electrophotographic photosensitive member and the contact region of the gap retaining member, the gap retaining member came into contact with the surface of the second region of the electrophotographic photosensitive member.

The adhesive force was evaluated as described below. In an environment at a temperature of 15° C. and a humidity of 10% RH, 50,000 sheets of images were formed with A4 sized normal paper at a printing rate of 1% in an intermittent mode in which stopping was performed every two sheets of image formation. After 50,000 sheets of images were formed, the adhesive state between the surface layer (charge transporting layer) of the electrophotographic photosensitive member and the undercoat layer in the second region was examined. As for the adhesive state, the electrophotographic photosensitive member was detached from the process cartridge in such a way that no damage was caused, and the peeling state of the charge transporting layer was visually evaluated. The criteria of the visual inspection were as described below. The results are shown in Table 6.

A: no change was observed in the film and, therefore, good

B: floating of the photosensitive layer in the film was slightly observed

C: floating of the photosensitive layer in the film was clearly observed, although peeling was not reached D: peeling of the film was observed Example 202

An electrophotographic photosensitive member was produced in the same manner as in Example 201 except that the polycarbonate resin in Example 201 was changed to a polycarbonate resin having a ratio of the structural unit represented by Formula (1-1) above to the structural unit represented by Formula (1-5) above of 6/4 (molar ratio) and a weight average molecular weight of 50,000. The adhesive force was evaluated in the same manner. The results are shown in Table 6.

Example 203

An electrophotographic photosensitive member was produced in the same manner as in Example 201 except that the polycarbonate resin in Example 201 was changed to a polycarbonate resin having a ratio of the structural unit represented by Formula (1-3) above to the structural unit represented by Formula (1-7) above of 5/5 (molar ratio) and a weight average molecular weight of 70,000. The adhesive force was evaluated in the same manner. The results are shown in Table 6.

Example 204

An electrophotographic photosensitive member was produced in the same manner as in Example 201 except that the polycarbonate resin in Example 201 was changed to a polyester resin having a ratio of the structural unit represented by Formula (2-1) above to the structural unit represented by Formula (2-2) above of 5/5 (molar ratio) and a weight average molecular weight of 100,000. The adhesive force was evaluated in the same manner. The results are shown in Table 6.

Example 205

An electrophotographic photosensitive member was produced in the same manner as in Example 201 except that the polycarbonate resin in Example 201 was changed to a polyester resin having the structural unit represented by Formula (2-5) above and a weight average molecular weight of 100,000. The adhesive force was evaluated in the same manner. The results are shown in Table 6.

Examples 206 to 210

The adhesive forces were evaluated in the same manner as in Examples 201 to 205 except that the contact forces of the gap retaining members in contact with the surfaces of the second regions of the electrophotographic photosensitive members in Examples 201 to 205 were specified to be 10 N. The results are shown in Table 6.

Examples 211 to 220

Electrophotographic photosensitive members were produced in the same manner as in Examples 201 to 210 except that the zinc oxide particle used in Examples 201 to 210 were changed to a titanium oxide particle whose surface has been treated with γ-aminopropyltrimethoxysilane. The adhesive forces were evaluated in the same manner as in Example 201. The results are shown in Table 6.

TABLE 6

| Example | Surface layer Resin | Undercoat layer Metal oxide | Undercoat layer Resin | Gap retaining member Width/mm | Gap retaining member Contact force/N | Adhesive force evaluation 50,000 sheets |
|---|---|---|---|---|---|---|
| 201 | polycarbonate resin (1-6) | zinc oxide | polyamide | 4 | 30 | B |
| 202 | copolymer (6/4) of polycarbonate resins (1-1) and (1-5) | zinc oxide | polyamide | 4 | 30 | B |
| 203 | copolymer (5/5) of polycarbonate resins (1-3) and (1-7) | zinc oxide | polyamide | 4 | 30 | B |
| 204 | copolymer (5/5) of polyester resins (2-1) and (2-2) | zinc oxide | polyamide | 4 | 30 | A |
| 205 | polyester resin (2-5) | zinc oxide | polyamide | 4 | 30 | A |
| 206 | polycarbonate resin (1-6) | zinc oxide | polyamide | 4 | 10 | A |
| 207 | copolymer (6/4) of polycarbonate resins (1-1) and (1-5) | zinc oxide | polyamide | 4 | 10 | A |
| 208 | copolymer (5/5) of polycarbonate resins (1-3) and (1-7) | zinc oxide | polyamide | 4 | 10 | A |
| 209 | copolymer (5/5) of polyester resins (2-1) and (2-2) | zinc oxide | polyamide | 4 | 10 | A |
| 210 | polyester resin (2-5) | zinc oxide | polyamide | 4 | 10 | A |
| 211 | polycarbonate resin (1-6) | titanium oxide | polyamide | 4 | 30 | A |
| 212 | copolymer (6/4) of polycarbonate resins (1-1) and (1-5) | titanium oxide | polyamide | 4 | 30 | A |
| 213 | copolymer (5/5) of polycarbonate resins (1-3) and (1-7) | titanium oxide | polyamide | 4 | 30 | A |
| 214 | copolymer (5/5) of polyester resins (2-1) and (2-2) | titanium oxide | polyamide | 4 | 30 | A |
| 215 | polyester resin (2-5) | titanium oxide | polyamide | 4 | 30 | A |
| 216 | polycarbonate resin (1-6) | titanium oxide | polyamide | 4 | 10 | A |
| 217 | copolymer (6/4) of polycarbonate resins (1-1) and (1-5) | titanium oxide | polyamide | 4 | 10 | A |
| 218 | copolymer (5/5) of polycarbonate resins (1-3) and (1-7) | titanium oxide | polyamide | 4 | 10 | A |
| 219 | copolymer (5/5) of polyester resins (2-1) and (2-2) | titanium oxide | polyamide | 4 | 10 | A |
| 220 | polyester resin (2-5) | titanium oxide | polyamide | 4 | 10 | A |

Examples 221 to 225

Electrophotographic photosensitive members were produced in the same manner as in Examples 201 to 205 except that the support (aluminum cylinder) in Examples 201 to 205 was changed to aluminum cylinder (JIS-A3003, aluminum alloy) having a length of 261.6 mm and a diameter of 24 mm.

The first region of the electrophotographic photosensitive member was a region from the position at 15 mm to the position at 246.6 mm from one end side of the support. The second regions of the electrophotographic photosensitive member were a region from the position at 3 mm to the position at 15 mm from the one end side of the support and a region from the position at 246.6 mm to the position at 258.6 mm from the one end side of the support.

Evaluation of Adhesive Force

A laser beam printer (trade name: HP LaserJet Enterprise 500 Color M551, contact developing system, print speed: A4 portrait orientation 30 sheets/min) produced by Hewlett-Packard Company was modified as an evaluation machine and the adhesive force was evaluated. The produced electrophotographic photosensitive member was fit to a process cartridge for HP LaserJet Enterprise 500 Color M551. In order to retain a distance between the electrophotographic photosensitive member and a developer bearing member, rotatable cylindrical POM gap retaining members having a width of 2 mm were allowed to come into contact centering the positions at about 9 mm from one end side and the other end side of the support. The contact force was specified to be 10 N. The image forming region of the electrophotographic photosensitive member fit to the process cartridge was specified to be a region from the position at 20 mm from one end side of the support to the position at 241.6 mm from the one end side of the support. Therefore, the non-image forming regions were a region from the position at 0 mm to the position at 20 mm from the one end side of the support and a region from the position at 241.6 mm to the position at 261.6 mm from the one end side of the support. Then, it was ascertained that the gap retaining member came into contact with the surface of the second region of the electrophotographic photosensitive member.

The adhesive force was evaluated as described below. In an environment at a temperature of 15° C. and a humidity of 10% RH, 25,000 sheets of images were formed with A4 sized normal paper at a printing rate of 1% in an intermittent mode in which stopping was performed every two sheets of image formation. After 25,000 sheets of images were formed, the adhesive state between the surface layer (charge transporting layer) of the electrophotographic photosensitive member and the undercoat layer in the second region was examined. As for the adhesive state, the electrophotographic photosensitive member was detached from the process cartridge in such a way that no damage was caused, and the peeling state of the charge transporting layer was visually evaluated. The criteria of the visual inspection were as described below. The results are shown in Table 7.

A: no change was observed in the film and, therefore, good
B: floating of the photosensitive layer in the film was slightly observed
C: floating of the photosensitive layer in the film was clearly observed, although peeling was not reached
D: peeling of the film was observed Examples 226 to 230

The adhesive forces were evaluated in the same manner as in Examples 221 to 225 except that the contact forces of the gap retaining members in contact with the surfaces of the second regions of the electrophotographic photosensitive members in Examples 221 to 225 were specified to be 3 N. The results are shown in Table 7.

Examples 231 to 240

Electrophotographic photosensitive members were produced in the same manner as in Examples 221 to 230 except that the zinc oxide particle in Examples 221 to 230 were changed to a titanium oxide particle whose surface has been treated with γ-aminopropyltrimethoxysilane. The adhesive forces were evaluated in the same manner as in Example 221. The results are shown in Table 7.

TABLE 7

| | | Undercoat layer | | Gap retaining member | | Adhesive force |
|---|---|---|---|---|---|---|
| Example | Surface layer Resin | Metal oxide | Resin | Width/ mm | Contact force/N | evaluation 25,000 sheets |
| 221 | polycarbonate resin (1-6) | zinc oxide | polyamide | 2 | 10 | A |
| 222 | copolymer (6/4) of polycarbonate resins (1-1) and (1-5) | zinc oxide | polyamide | 2 | 10 | A |
| 223 | copolymer (5/5) of polycarbonate resins (1-3) and (1-7) | zinc oxide | polyamide | 2 | 10 | A |
| 224 | copolymer (5/5) of polyester resins (2-1) and (2-2) | zinc oxide | polyamide | 2 | 10 | A |
| 225 | polyester resin (2-5) | zinc oxide | polyamide | 2 | 10 | A |
| 226 | polycarbonate resin (1-6) | zinc oxide | polyamide | 2 | 3 | A |
| 227 | copolymer (6/4) of polycarbonate resins (1-1) and (1-5) | zinc oxide | polyamide | 2 | 3 | A |
| 228 | copolymer (5/5) of polycarbonate resins (1-3) and (1-7) | zinc oxide | polyamide | 2 | 3 | A |
| 229 | copolymer (5/5) of polyester resins (2-1) and (2-2) | zinc oxide | polyamide | 2 | 3 | A |
| 230 | polyester resin (2-5) | zinc oxide | polyamide | 2 | 3 | A |
| 231 | polycarbonate resin (1-6) | titanium oxide | polyamide | 2 | 10 | A |
| 232 | copolymer (6/4) of polycarbonate resins (1-1) and (1-5) | titanium oxide | polyamide | 2 | 10 | A |
| 233 | copolymer (5/5) of polycarbonate resins (1-3) and (1-7) | titanium oxide | polyamide | 2 | 10 | A |
| 234 | copolymer (5/5) of polyester resins (2-1) and (2-2) | titanium oxide | polyamide | 2 | 10 | A |
| 235 | polyester resin (2-5) | titanium oxide | polyamide | 2 | 10 | A |
| 236 | polycarbonate resin (1-6) | titanium oxide | polyamide | 2 | 3 | A |
| 237 | copolymer (6/4) of polycarbonate resins (1-1) and (1-5) | titanium oxide | polyamide | 2 | 3 | A |
| 238 | copolymer (5/5) of polycarbonate resins (1-3) and (1-7) | titanium oxide | polyamide | 2 | 3 | A |
| 239 | copolymer (5/5) of polyester resins (2-1) and (2-2) | titanium oxide | polyamide | 2 | 3 | A |
| 240 | polyester resin (2-5) | titanium oxide | polyamide | 2 | 3 | A |

Comparative Example 1

An electrophotographic photosensitive member was produced in the same manner as in Example 1 except that the coating liquid for undercoat layer used in Example 1 was prepared as described below. The adhesive force was evaluated in the same manner. The results are shown in Table 8.

A dispersion was prepared by adding 160 parts of titanium oxide particles covered with oxygen-deficient tin oxide and 100 parts of phenol resin (trade name: Plyophen J-325, resin solid content: 60 percent by mass, produced by DIC Corporation) to 50 parts of 1-methoxy-2-propanol. The resulting dispersion was subjected to a dispersion treatment by using glass beads having an average particle diameter of 0.8 mm with a vertical sand mill in an atmosphere at 18° C. for 4.5 hours. After the dispersion treatment, a coating liquid for undercoat layer was prepared by adding 22 parts of silicone resin particles (trade name: Tospearl 120, produced by Momentive Performance Materials Inc., average particle diameter: 2 μm) and 0.002 parts of silicone oil (trade name: SH28PA) to the resulting dispersion and performing agitation. A support was dip-coated with the resulting coating liquid for undercoat layer to form a coating film, the coating film was heated at 150° C. for 30 minutes to cause polymerization, so that an undercoat layer having a film thickness of 30 μm was formed.

Comparative Example 2

An electrophotographic photosensitive member was produced in the same manner as in Example 4 except that the coating liquid for undercoat layer used in Example 4 was changed to the coating liquid for undercoat layer described in Comparative example 1. The adhesive force was evaluated in the same manner. The results are shown in Table 8.

Comparative Example 3

An electrophotographic photosensitive member was produced in the same manner as in Example 6 except that the coating liquid for undercoat layer used in Example 6 was changed to the coating liquid for undercoat layer described in Comparative example 1. The adhesive force was evaluated in the same manner. The results are shown in Table 8.

Comparative Example 4

An electrophotographic photosensitive member was produced in the same manner as in Example 9 except that the coating liquid for undercoat layer used in Example 9 was changed to the coating liquid for undercoat layer described in Comparative example 1. The adhesive force was evaluated in the same manner. The results are shown in Table 8.

TABLE 8

| | | Undercoat layer | | Gap retaining member | | Adhesive force |
|---|---|---|---|---|---|---|
| Comparative example | Surface layer Resin | Metal oxide | Resin | Width/ mm | Contact force/N | evaluation 50,000 sheets |
| 1 | polycarbonate resin (1-6) | titanium oxide | phenol | 4 | 30 | D |
| 2 | copolymer (5/5) of polyester resins (2-1) and (2-2) | titanium oxide | phenol | 4 | 30 | D |
| 3 | polycarbonate resin (1-6) | titanium oxide | phenol | 4 | 10 | D |
| 4 | copolymer (5/5) of polyester resins (2-1) and (2-2) | titanium oxide | phenol | 4 | 10 | D |

Comparative Example 5

An electrophotographic photosensitive member was produced in the same manner as in Comparative example 1 except that the support in Comparative example 1 was changed to aluminum cylinder (JIS-A3003, aluminum alloy) having a length of 261.6 mm and a diameter of 24 mm. The adhesive force was evaluated in the same manner as in Example 21. The results are shown in Table 9.

Comparative Example 6

An electrophotographic photosensitive member was produced in the same manner as in Comparative example 2 except that the support in Comparative example 2 was changed to aluminum cylinder (JIS-A3003, aluminum alloy) having a length of 261.6 mm and a diameter of 24 mm. The adhesive force was evaluated in the same manner as in Example 21. The results are shown in Table 9.

Comparative Example 7

An electrophotographic photosensitive member was produced in the same manner as in Comparative example 3 except that the support in Comparative example 3 was changed to aluminum cylinder (JIS-A3003, aluminum alloy) having a length of 261.6 mm and a diameter of 24 mm. The adhesive force was evaluated in the same manner as in Example 21. The results are shown in Table 9.

Comparative Example 8

An electrophotographic photosensitive member was produced in the same manner as in Comparative example 4 except that the support in Comparative example 4 was changed to aluminum cylinder (JIS-A3003, aluminum alloy) having a length of 261.6 mm and a diameter of 24 mm. The adhesive force was evaluated in the same manner as in Example 21. The results are shown in Table 9.

TABLE 9

| | | Undercoat layer | | Gap retaining member | | Adhesive force |
|---|---|---|---|---|---|---|
| Comparative example | Surface layer Resin | Metal oxide | Resin | Width/ mm | Contact force/N | evaluation 25,000 sheets |
| 5 | polycarbonate resin (1-6) | titanium oxide | phenol | 2 | 10 | D |
| 6 | copolymer (5/5) of polyester resins (2-1) and (2-2) | titanium oxide | phenol | 2 | 10 | D |
| 7 | polycarbonate resin (1-6) | titanium oxide | phenol | 2 | 3 | D |
| 8 | copolymer (5/5) of polyester resins (2-1) and (2-2) | titanium oxide | phenol | 2 | 3 | D |

Next, in order to evaluate the adhesive force of the electrophotographic photosensitive member alone, a cross-cut test was performed with respect to Examples 1 to 5, 11 to 15, 101 to 105, 111 to 115, 201 to 205, and 211 to 215 and Comparative examples 1 and 2. In the cross-cut test, an electrophotographic photosensitive member was produced separately from the evaluation of the adhesive force, and evaluation was performed by using the second region of the electrophotographic photosensitive member.

Cross-Cut Test

The cross-cut test was performed on the basis of JIS K5600-5-6. In this regard, as for the evaluation, the cross-cut test was performed after standing in an environment at a temperature of 15° C. and a humidity of 10% RH for 48 hours or more. Cutting was performed manually by using a single cutting tool while the edge was put at an angle of about 60° C. to the coating film. The film thickness of the coating film of the produced electrophotographic photosensitive member was about 50 μm and, therefore, the interval of cutting was specified to be 1 mm.

The cross-cut test was performed with respect to the second region in the pull-up start end portion and the second region in the pull-up finish end portion in the electrophotographic photosensitive member production period. The evaluation was performed on the basis of the average value of the number of peeled squares of 25 squares. The results are shown in Table 10.

TABLE 10

| | Surface layer | Undercoat layer | | Cross-cut test Number of |
|---|---|---|---|---|
| Electrophotographic photosensitive member | Resin | Metal oxide | Resin | peeled squares |
| Electrophotographic photosensitive member of Example 1 | polycarbonate resin (1-6) | zinc oxide | urethane | 2.0 |
| Electrophotographic photosensitive member of Example 2 | copolymer (6/4) of polycarbonate resins (1-1) and (1-5) | zinc oxide | urethane | 2.0 |
| Electrophotographic photosensitive member of Example 3 | copolymer (5/5) of polycarbonate resins (1-3) and (1-7) | zinc oxide | urethane | 2.5 |
| Electrophotographic photosensitive member of Example 4 | copolymer (5/5) of polyester resins (2-1) and (2-2) | zinc oxide | urethane | 1.0 |
| Electrophotographic photosensitive member of Example 5 | polyester resin (2-5) | zinc oxide | urethane | 1.0 |
| Electrophotographic photosensitive member of Example 11 | polycarbonate resin (1-6) | titanium oxide | urethane | 2.5 |
| Electrophotographic photosensitive member of Example 12 | copolymer (6/4) of polycarbonate resins (1-1) and (1-5) | titanium oxide | urethane | 3.0 |
| Electrophotographic photosensitive member of Example 13 | copolymer (5/5) of polycarbonate resins (1-3) and (1-7) | titanium oxide | urethane | 3.0 |
| Electrophotographic photosensitive member of Example 14 | copolymer (5/5) of polyester resins (2-1) and (2-2) | titanium oxide | urethane | 1.5 |
| Electrophotographic photosensitive member of Example 15 | polyester resin (2-5) | titanium oxide | urethane | 1.0 |
| Electrophotographic photosensitive member of Example 101 | polycarbonate resin (1-6) | zinc oxide | amino | 6.0 |
| Electrophotographic photosensitive member of Example 102 | copolymer (6/4) of polycarbonate resins (1-1) and (1-5) | zinc oxide | amino | 6.5 |
| Electrophotographic photosensitive member of Example 103 | copolymer (5/5) of polycarbonate resins (1-3) and (1-7) | zinc oxide | amino | 6.5 |
| Electrophotographic photosensitive member of Example 104 | copolymer (5/5) of polyester resins (2-1) and (2-2) | zinc oxide | amino | 4.5 |
| Electrophotographic photosensitive member of Example 105 | polyester resin (2-5) | zinc oxide | amino | 4.0 |
| Electrophotographic photosensitive member of Example 111 | polycarbonate resin (1-6) | titanium oxide | amino | 5.0 |
| Electrophotographic photosensitive member of Example 112 | copolymer (6/4) of polycarbonate resins (1-1) and (1-5) | titanium oxide | amino | 5.5 |
| Electrophotographic photosensitive member of Example 113 | copolymer (5/5) of polycarbonate resins (1-3) and (1-7) | titanium oxide | amino | 6.0 |
| Electrophotographic photosensitive member of Example 114 | copolymer (5/5) of polyester resins (2-1) and (2-2) | titanium oxide | amino | 3.0 |
| Electrophotographic photosensitive member of Example 115 | polyester resin (2-5) | titanium oxide | amino | 3.0 |
| Electrophotographic photosensitive member of Example 201 | polycarbonate resin (1-6) | zinc oxide | polyamide | 5.0 |
| Electrophotographic photosensitive member of Example 202 | copolymer (6/4) of polycarbonate resins (1-1) and (1-5) | zinc oxide | polyamide | 5.5 |
| Electrophotographic photosensitive member of Example 203 | copolymer (5/5) of polycarbonate resins (1-3) and (1-7) | zinc oxide | polyamide | 5.5 |
| Electrophotographic photosensitive member of Example 204 | copolymer (5/5) of polyester resins (2-1) and (2-2) | zinc oxide | polyamide | 3.5 |
| Electrophotographic photosensitive member of Example 205 | polyester resin (2-5) | zinc oxide | polyamide | 3.5 |
| Electrophotographic photosensitive member of Example 211 | polycarbonate resin (1-6) | titanium oxide | polyamide | 4.5 |
| Electrophotographic photosensitive member of Example 212 | copolymer (6/4) of polycarbonate resins (1-1) and (1-5) | titanium oxide | polyamide | 4.5 |
| Electrophotographic photosensitive member of Example 213 | copolymer (5/5) of polycarbonate resins (1-3) and (1-7) | titanium oxide | polyamide | 5.0 |
| Electrophotographic photosensitive member of Example 214 | copolymer (5/5) of polyester resins (2-1) and (2-2) | titanium oxide | polyamide | 2.5 |

TABLE 10-continued

| Electrophotographic photosensitive member | Surface layer Resin | Undercoat layer Metal oxide | Undercoat layer Resin | Cross-cut test Number of peeled squares |
|---|---|---|---|---|
| Electrophotographic photosensitive member of Example 215 | polyester resin (2-5) | titanium oxide | polyamide | 2.5 |
| Electrophotographic photosensitive member of Comparative example 1 | polycarbonate resin (1-6) | titanium oxide | phenol | 25 |
| Electrophotographic photosensitive member of Comparative example 2 | copolymer (5/5) of polyester resins (2-1) and (2-2) | titanium oxide | phenol | 25 |

While aspects of the present invention have been described with reference to exemplary embodiments, it is to be understood that these exemplary embodiments are not seen to be limiting. The scope of the following claims is to be accorded the broadest interpretation so as to encompass all such modifications and equivalent structures and functions.

This application claims the benefit of Japanese Patent Application No. 2014-170998, filed Aug. 25, 2014, Japanese Patent Application No. 2014-262504, filed Dec. 25, 2014, and Japanese Patent Application No. 2015-134772, filed Jul. 3, 2015, which are hereby incorporated by reference herein in their entirety.

What is claimed is:

1. A process cartridge detachably mountable to a main body of an electrophotographic apparatus, comprising:

an electrophotographic photosensitive member;

a charging member for charging the electrophotographic photosensitive member;

a developer bearing member for supplying developer to the electrophotographic photosensitive member; and a gap retaining member configured to retain a distance between the electrophotographic photosensitive member and the charging member or the developer bearing member;

wherein the electrophotographic photosensitive member comprises:

a first region having a support, an undercoat layer on the support, a charge generating layer on the undercoat layer, and a charge transporting layer as the surface layer on the charge generating layer; and a second region having the support, the undercoat layer, on the support, and the charge transporting layer being in contact with the undercoat layer, the charge generating layer not being interposed between the undercoat layer and the charge transporting layer;

wherein the gap retaining member comes into contact with a surface of the second region of the electrophotographic photosensitive member, and not the first region of the electrophotographic photosensitive member;

wherein the charge transporting layer comprises a charge transporting substance and at least one selected from the group consisting of a polycarbonate resin and a polyester resin, wherein the undercoat layer comprises a metal oxide particle and an urethane resin as a binder resin;

wherein the urethane resin is a polymer of a composition containing an isocyanate compound having an isocyanate group or a block isocyanate group, and a thermoplastic resin having a hydroxyl group;

wherein the isocyanate compound comprises an isocyanurate-modified products and has a molecular weight of 200 to 1,300; and wherein the thermoplastic resin has a hydroxyl value of 50 mgKOH/g or more and a weight average molecular weight of 5,000 to 400,000.

2. The process cartridge according to claim 1, wherein the first region of the electrophotographic photosensitive member is present in an image forming region of the electrophotographic photosensitive member, and wherein the second region of the electrophotographic photosensitive member is present in a non-image forming region of the electrophotographic photosensitive member.

3. The process cartridge according to claim 2, wherein the first region of the electrophotographic photosensitive member is further present on the image forming region side of the non-image forming region of the electrophotographic photosensitive member.

4. The process cartridge according to claim 1, wherein a film thickness of the under coat layer is 5to 35 μm.

5. An electrophotographic apparatus comprising:

an electrophotographic photosensitive member;

a charging member for charging the electrophotographic photosensitive member;

a developer bearing member for supplying developer to the electrophotographic photosensitive member; and a gap retaining member configured to retain a distance between the electrophotographic photosensitive member and the charging member or the developer bearing member;

wherein the electrophotographic photosensitive member comprises:

a first region having a support, an undercoat layer on the support, a charge generating layer on the undercoat layer, and a charge transporting layer as the surface layer on the charge generating layer; and a second region having the support, the undercoat layer on the support, and the charge transporting layer being in contact with the undercoat layer the charge generating layer not being interposed between the undercoat layer and the charge transporting layer;

wherein the charge transporting layer comprises a charge transporting substance and at least one selected from the group consisting of a polycarbonate resin and a polyester resin, wherein the undercoat layer comprises a metal oxide particle and an urethane resin as a binder resin;

wherein gap retaining member comes into contact with a surface of the second region of the electrophotographic photosensitive member, and not the first region of the electrophotographic photosensitive member;

wherein the urethane resin is a polymer of a composition containing an isocyanate compound having an isocyanate group or a block isocyanate group, and a thermoplastic resin having a hydroxyl group;

wherein the isocyanate compound comprises an isocyanurate-modified products and has a molecular weight of 200 to 1,300; and wherein the thermoplastic resin has a hydroxyl value of 50 mgKOH/g or more and a weight average molecular weight of 5,000 to 400,000.

6. The electrophotographic apparatus according to claim 5, wherein the first region of the electrophotographic photosensitive member is present in an image forming region of the electrophotographic photosensitive member, and wherein the second region of the electrophotographic photosensitive member is present in a non-image forming region of the electrophotographic photosensitive member.

7. The electrophotographic apparatus according to claim 6, wherein the first region of the electrophotographic photosensitive member is further present on the image forming region side of the non-image forming region of the electrophotographic photosensitive member.

8. An electrophotographic photosensitive member comprising:

a first region having a support, an undercoat layer on the support, a charge generating layer on the undercoat layer, and a charge transporting layer as the surface layer on the charge generating layer; and a second region having the support, the undercoat layer on the support, and the charge transporting layer being in contact with the undercoat layer, the charge generating layer not being interposed between the undercoat layer and the charge transporting layer;

wherein the charge transporting layer comprises a charge transporting substance and at least on selected from the group consisting of a polycarbonate resin and a polyester resin, and wherein the undercoat layer comprises a metal oxide particle and an urethane resin as a binder resin;

wherein the gap retaining member comes into contact with a surface of the second region of the electrophotographic photosensitive member, and not the first region of the electrophotographic photosensitive member;

wherein the urethane resin is a polymer of a composition containing an isocyanate compound having an isocyanate group or a block isocyanate group, and a thermoplastic resin having a hydroxyl group;

wherein the isocyanate compound comprises an isocyanurate-modified products and has a molecular weight of 200 to 1,300; and wherein the thermoplastic resin has a hydroxyl value of 50 mgKOH/g or more and a weight average molecular weight of 5,000 to 400,000.

* * * * *